US009685167B2

(12) United States Patent
Seo et al.

(10) Patent No.: US 9,685,167 B2
(45) Date of Patent: Jun. 20, 2017

(54) MULTI-OBJECT AUDIO ENCODING AND DECODING APPARATUS SUPPORTING POST DOWN-MIX SIGNAL

(75) Inventors: Jeongil Seo, Daejeon (KR); Seungkwon Beack, Daejeon (KR); Kyeongok Kang, Daejeon (KR); Jin Woo Hong, Daejeon (KR); Jinwoong Kim, Daejeon (KR); Chieteuk Ahn, Daejeon (KR); Kwangki Kim, Daejeon (KR); Minsoo Hahn, Daejeon (KR)

(73) Assignee: ELECTRONICS AND TELECOMMUNICATIONS RESEARCH INSTITUTE, Daejeon (KR)

( * ) Notice: Subject to any disclaimer, the term of this patent is extended or adjusted under 35 U.S.C. 154(b) by 193 days.

(21) Appl. No.: 13/054,662

(22) PCT Filed: Jul. 16, 2009

(86) PCT No.: PCT/KR2009/003938

§ 371 (c)(1),
(2), (4) Date: Jan. 18, 2011

(87) PCT Pub. No.: WO2010/008229

PCT Pub. Date: Jan. 21, 2010

(65) Prior Publication Data

US 2011/0166867 A1 Jul. 7, 2011

(30) Foreign Application Priority Data

Jul. 16, 2008 (KR) ..... 10-2008-0068861
Sep. 24, 2008 (KR) ..... 10-2008-0093557
(Continued)

(51) Int. Cl.
*G10L 19/20* (2013.01)
*G10L 19/008* (2013.01)

(52) U.S. Cl.
CPC ..... *G10L 19/20* (2013.01); *G10L 19/008* (2013.01)

(58) Field of Classification Search
CPC ..... G10L 19/008
(Continued)

(56) References Cited

U.S. PATENT DOCUMENTS 5,636,324 A * 6/1997 Teh et al. ..... 704/226
7,394,903 B2 * 7/2008 Herre et al. ..... 381/23
(Continued)

FOREIGN PATENT DOCUMENTS

KR 10-2007-0003544 1/2007
KR 10-2008-0063155 7/2008
(Continued)

OTHER PUBLICATIONS

Herre, J. Disch, S., "New Concepts in Parametric Coding of Spatial Audio", From SAC to SAOC, Multimedia and Expo, 2007 IEEE International Conference, Issue date Jul. 2-5, 2007.
(Continued)

*Primary Examiner* — Jialong He
(74) *Attorney, Agent, or Firm* — Staas & Halsey LLP

(57) ABSTRACT

A multi-object audio encoding and decoding apparatus supporting a post downmix signal may be provided. The multi-object audio encoding apparatus may include: an object information extraction and downmix generation unit to generate object information and a downmix signal from input object signals; a parameter determination unit to determine a downmix information parameter using the extracted downmix signal and the post downmix signal; and a bitstream generation unit to combine the object information and the downmix information parameter, and to generate an object bitstream.

11 Claims, 9 Drawing Sheets

(30) Foreign Application Priority Data

| | | |
|---|---|---|
| Oct. 10, 2008 | (KR) | 10-2008-0099629 |
| Oct. 14, 2008 | (KR) | 10-2008-0100807 |
| Oct. 16, 2008 | (KR) | 10-2008-0101451 |
| Nov. 5, 2008 | (KR) | 10-2008-0109318 |
| Jan. 28, 2009 | (KR) | 10-2009-0006716 |
| Jul. 7, 2009 | (KR) | 10-2009-0061736 |

(58) Field of Classification Search
USPC ..... 704/503, 504
See application file for complete search history.

(56) References Cited

U.S. PATENT DOCUMENTS

| | | | | |
|---|---|---|---|---|
| 8,073,702 | B2 * | 12/2011 | Pang | G10L 19/008 381/106 |
| 2001/0026513 | A1 * | 10/2001 | Koyata | 369/47.26 |
| 2002/0093591 | A1 * | 7/2002 | Gong et al. | 348/515 |
| 2005/0074127 | A1 * | 4/2005 | Herre et al. | 381/20 |
| 2005/0157883 | A1 * | 7/2005 | Herre et al. | 381/17 |
| 2006/0133618 | A1 * | 6/2006 | Villemoes et al. | 381/20 |
| 2006/0233379 | A1 * | 10/2006 | Villemoes et al. | 381/23 |
| 2007/0016416 | A1 | 1/2007 | Roden et al. | |
| 2007/0233293 | A1 | 10/2007 | Villemoes et al. | |
| 2007/0280485 | A1 * | 12/2007 | Villemoes | 381/22 |
| 2008/0027718 | A1 * | 1/2008 | Krishnan et al. | 704/211 |
| 2008/0126086 | A1 * | 5/2008 | Vos et al. | 704/225 |
| 2008/0167880 | A1 * | 7/2008 | Seo et al. | 704/500 |
| 2008/0201152 | A1 * | 8/2008 | Pang et al. | 704/500 |
| 2009/0125313 | A1 * | 5/2009 | Hellmuth | G10L 19/008 704/501 |
| 2009/0125314 | A1 * | 5/2009 | Hellmuth et al. | 704/501 |
| 2009/0245524 | A1 * | 10/2009 | Jung et al. | 381/2 |
| 2010/0114582 | A1 * | 5/2010 | Beack | H04S 7/30 704/500 |
| 2011/0166867 | A1 * | 7/2011 | Seo et al. | 704/500 |

FOREIGN PATENT DOCUMENTS

| | | | |
|---|---|---|---|
| KR | 10-2008-0066808 | | 7/2008 |
| WO | 2006/060278 | A1 | 6/2006 |
| WO | 2007/004830 | | 1/2007 |
| WO | 2007/004830 | A1 | 1/2007 |
| WO | WO 2007/097842 | | 8/2007 |

OTHER PUBLICATIONS

International Search Report for PCT/KR2009/003938, mailed Oct. 30, 2009.

Lars Villemoes et al., "MPEG Surround: The Forthcoming ISO Standard for Spatial Audio Coding", AES 28$^{th}$ International Conference, Pitea, Sweden, Jun. 30-Jul. 2, 2006, pp. 1-18.

Jürgen Herre et al., "MPEG Surround—The ISO/MPEG Standard for Efficient and Compatible Multi-Channel Audio Coding", Audio Engineering Society Convention Paper 7084, Presented at the 122$^{nd}$ Convention May 5-8, 2007 Vienna, Austria. pp. 1-23.

Jeroen Breebaart et al., "Background, Concept, and Architecture for the Recent MPEG Surround Standard on Multichannel Audio Compression", J. Audio Eng Soc . . . vol. 55. No. 5, May 2007, pp. 331-351.

Jürgen Herre et al., "New Concepts in Parametric Coding of Spatial Audio: From SAC to SAOC", IEEE 2007, pp. 1894-1897.

* cited by examiner

MULTI-OBJECT AUDIO ENCODING AND DECODING APPARATUS SUPPORTING POST DOWN-MIX SIGNAL

CROSS REFERENCE TO RELATED APPLICATIONS

This application claims the benefit under 35 U.S.C. Section 371, of PCT International Application No. PCT/KR2009/003938, filed Jul. 16, 2009, which claimed priority to Korean Application Nos. 10-2008-0068861 filed Jul. 16, 2008, 10-2008-0093557 filed Sep. 24, 2008, 10-2008-0099629 filed Oct. 10, 2008, 10-2008-0100807 filed Oct. 14, 2008, 10-2008-0101451 filed Oct. 16, 2008, 10-2008-0109318 filed Nov. 5, 2008, 10-2009-0006716 filed Jan. 28, 2009, 10-2009-0061736 filed Jul. 7, 2009, the disclosures of which are hereby incorporated by reference.

TECHNICAL FIELD

The present invention relates to a multi-object audio encoding and decoding apparatus, and more particularly, to a multi-object audio encoding and decoding apparatus which may support a post downmix signal, inputted from an outside, and efficiently represent a downmix information parameter associated with a relationship between a general downmix signal and the post downmix signal.

BACKGROUND ART

Currently, an object-based audio encoding technology that may efficiently compress an audio object signal is the focus of attention. A quantization/dequantization scheme of a parameter for supporting an arbitrary downmix signal of an existing Moving Picture Experts Group (MPEG) Surround technology may extract a Channel Level Difference (CLD) parameter between an arbitrary downmix signal and a downmix signal of an encoder. Also, the quantization/dequantization scheme may perform quantization/dequantization using a CLD quantization table symmetrically designed based on 0 dB in an MPEG Surround scheme.

A mastering downmix signal may be generated when a plurality of instruments/tracks are mixed as a stereo signal, are amplified to have a maximum dynamic range that a Compact Disc (CD) may represent, and are converted by an equalizer, and the like. Accordingly, a mastering downmix signal may be different from a stereo mixing signal.

When an arbitrary downmix processing technology of an MPEG Surround scheme is applied to a multi-object audio encoder to support a mastering downmix signal, a CLD between a downmix signal and a mastering downmix signal may be asymmetrically extracted due to a downmix gain of each object. Here, the CLD may be obtained by multiplying each of the objects with the downmix gain. Accordingly, only one side of an existing CLD quantization table may be used, and thus a quantization error occurring during a quantization/dequantization of a CLD parameter may be significant.

Accordingly, a method of efficiently encoding/decoding an audio object is required.

DISCLOSURE OF INVENTION

Technical Goals

An aspect of the present invention provides a multi-object audio encoding and decoding apparatus which supports a post downmix signal.

An aspect of the present invention also provides a multi-object audio encoding and decoding apparatus which may enable an asymmetrically extracted downmix information parameter to be evenly and symmetrically distributed with respect to 0 dB, based on a downmix gain which is multiplied with each object, may perform quantization and dequantization, and thereby may reduce a quantization error.

An aspect of the present invention also provides a multi-object audio encoding and decoding apparatus which may adjust a post downmix signal to be similar to a downmix signal generated during an encoding operation using a downmix information parameter, and thereby may reduce sound degradation.

Technical Solutions

According to an aspect of the present invention, there is provided a multi-object audio encoding apparatus which encodes a multi-object audio using a post downmix signal inputted from an outside.

The multi-object audio encoding apparatus may include: an object information extraction and downmix generation unit to generate object information and a downmix signal from input object signals; a parameter determination unit to determine a downmix information parameter using the extracted downmix signal and the post downmix signal; and a bitstream generation unit to combine the object information and the downmix information parameter, and to generate an object bitstream.

The parameter determination unit may include: a power offset calculation unit to scale the post downmix signal as a predetermined value to enable an average power of the post downmix signal in a particular frame to be identical to an average power of the downmix signal; and a parameter extraction unit to extract the downmix information parameter from the scaled post downmix signal in the predetermined frame.

The parameter determination unit may determine the PDG which is downmix parameter information to compensate for a difference between the downmix signal and the post downmix signal, and the bitstream generation unit may transmit the object bitstream including the PDG.

The parameter determination unit may generate a residual signal corresponding to the difference between the downmix signal and the post downmix signal, and the bitstream generation unit may transmit the object bitstream including the residual signal. The difference between the downmix signal and the post downmix signal may be compensated for by applying the post downmix gain.

According to an aspect of the present invention, there is provided a multi-object audio decoding apparatus which decodes a multi-object audio using a post downmix signal inputted from an outside.

The multi-object audio decoding apparatus may include: a bitstream processing unit to extract a downmix information parameter and object information from an object bitstream; a downmix signal generation unit to adjust the post downmix signal based on the downmix information parameter and generate a downmix signal; and a decoding unit to decode the downmix signal using the object information and generate an object signal.

The multi-object audio decoding apparatus may further include a rendering unit to perform rendering with respect to the generated object signal using user control information, and to generate a reproducible output signal.

The downmix signal generation unit may include: a power offset compensation unit to scale the post downmix signal using a power offset value extracted from the downmix information parameter; and a downmix signal adjusting unit to convert the scaled post downmix signal into the downmix signal using the downmix information parameter.

According to another aspect of the present invention, there is provided a multi-object audio decoding apparatus, including: a bitstream processing unit to extract a downmix information parameter and object information from an object bitstream; a downmix signal generation unit to generate a downmix signal using the downmix information parameter and a post downmix signal; a transcoding unit to perform transcoding with respect to the downmix signal using the object information and user control information; a downmix signal preprocessing unit to preprocess the downmix signal using a result of the transcoding; and a Moving Picture Experts Group (MPEG) Surround decoding unit to perform MPEG Surround decoding using the result of the transcoding and the preprocessed downmix signal.

Advantageous Effects

According to an embodiment of the present invention, there is provided a multi-object audio encoding and decoding apparatus which supports a post downmix signal.

According to an embodiment of the present invention, there is provided a multi-object audio encoding and decoding apparatus which may enable an asymmetrically extracted downmix information parameter to be evenly and symmetrically distributed with respect to 0 dB, based on a downmix gain which is multiplied with each object, may perform quantization and dequantization, and thereby may reduce a quantization error.

According to an embodiment of the present invention, there is provided a multi-object audio encoding and decoding apparatus which may adjust a post downmix signal to be similar to a downmix signal generated during an encoding operation using a downmix information parameter, and thereby may reduce sound degradation.

BEST MODE FOR CARRYING OUT THE INVENTION

Figure 1:
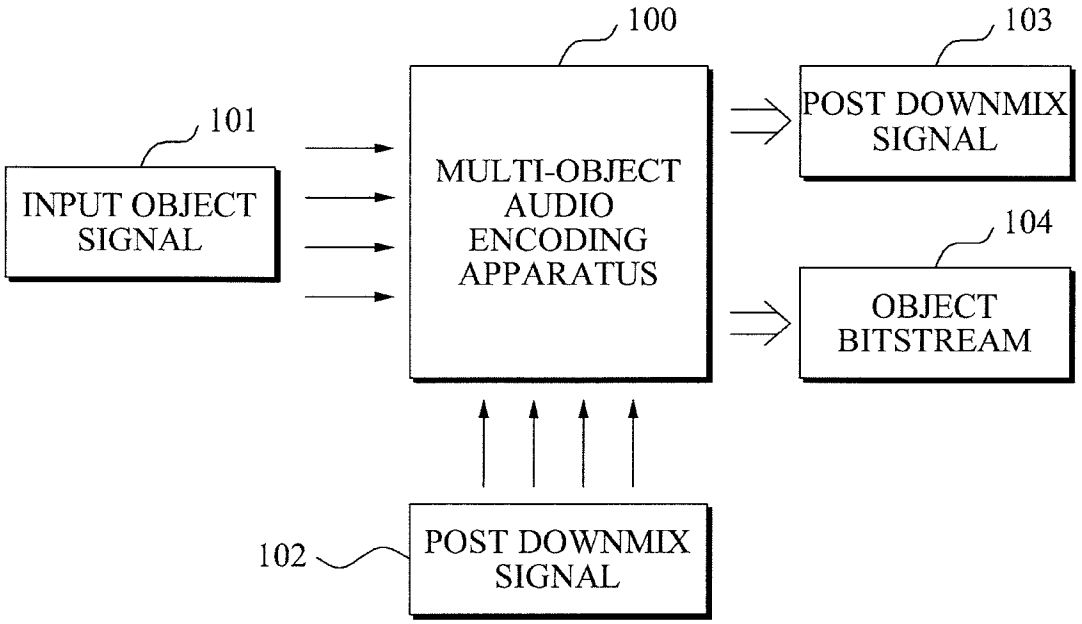
FIG. 1 is a block diagram illustrating a multi-object audio encoding apparatus supporting a post downmix signal according to an embodiment of the present invention.

Reference will now be made in detail to embodiments of the present invention, examples of which are illustrated in the accompanying drawings, wherein like reference numerals refer to the like elements throughout. The embodiments are described below in order to explain the present invention by referring to the figures.

FIG. 1 is a block diagram illustrating a multi-object audio encoding apparatus 100 supporting a post downmix signal according to an embodiment of the present invention.

The multi-object audio encoding apparatus 100 may encode a multi-object audio signal using a post downmix signal inputted from an outside. The multi-object audio encoding apparatus 100 may generate a downmix signal and object information using input object signals 101. In this instance, the object information may indicate spatial cue parameters predicted from the input object signals 101.

Also, the multi-object audio encoding apparatus 100 may analyze a downmix signal and an additionally inputted post downmix signal 102, and thereby may generate a downmix information parameter to adjust the post downmix signal 102 to be similar to the downmix signal. The downmix signal may be generated when encoding is performed. The multi-object audio encoding apparatus 100 may generate an object bitstream 104 using the downmix information parameter and the object information. Also, the inputted post downmix signal 102 may be directly outputted as a post downmix signal 103 without a particular process for replay.

In this instance, the downmix information parameter may be quantized/dequantized using a Channel Level Difference (CLD) quantization table by extracting a CLD parameter between the downmix signal and the post downmix signal 102. The CLD quantization table may be symmetrically designed with respect to a predetermined center. For example, the multi-object audio encoding apparatus 100 may enable a CLD parameter, asymmetrically extracted, to be symmetrical with respect to a predetermined center, based on a downmix gain applied to each object signal. According to the present invention, an object signal may be referred to as an object.

Figure 2:
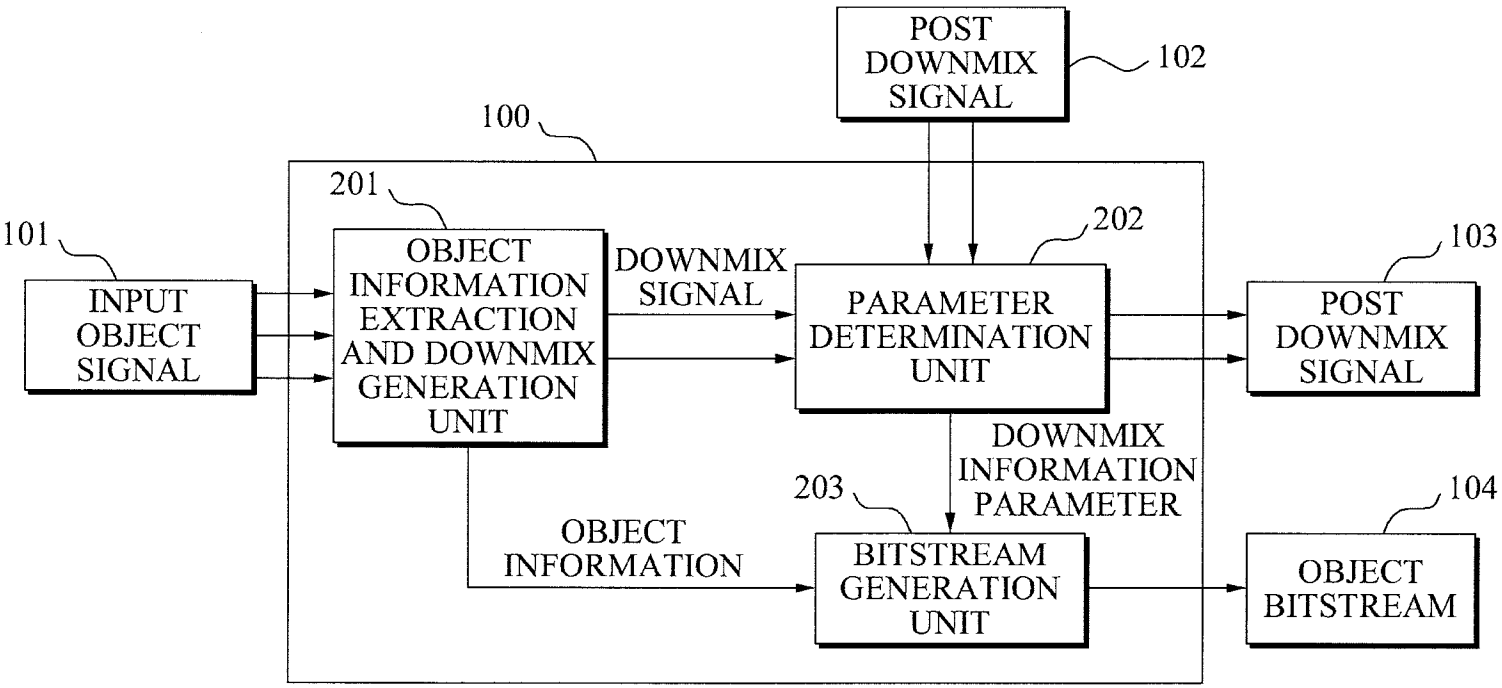
FIG. 2 is a block diagram illustrating a configuration of a multi-object audio encoding apparatus supporting a post downmix signal according to an embodiment of the present invention.

FIG. 2 is a block diagram illustrating a configuration of a multi-object audio encoding apparatus 100 supporting a post downmix signal according to an embodiment of the present invention.

Referring to FIG. 2, the multi-object audio encoding apparatus 100 may include an object information extraction and downmix generation unit 201, a parameter determination unit 202, and a bitstream generation unit 203. The multi-object audio encoding apparatus 100 may support a post downmix signal 102 inputted from an outside. According to the present invention, post downmix may indicate a mastering downmix signal.

The object information extraction and downmix generation unit 201 may generate object information and a downmix signal from the input object signals 101.

The parameter determination unit 202 may determine a downmix information parameter by analyzing the extracted downmix signal and the post downmix signal 102. The parameter determination unit 202 may calculate a signal strength difference between the downmix signal and the post downmix signal 102 to determine the downmix information parameter. Also, the inputted post downmix signal 102 may be directly outputted as a post downmix signal 103 without a particular process for replay.

For example, the parameter determination unit 202 may determine a Post Downmix Gain (PDG) as the downmix information parameter. The PDG may be evenly and symmetrically distributed by adjusting the post downmix signal 102 to be maximally similar to the downmix signal. Specifically, the parameter determination unit 202 may determine a downmix information parameter, asymmetrically extracted, to be evenly and symmetrically distributed with respect to 0 dB based on a downmix gain. Here, the downmix information parameter may be the PDG, and the downmix gain may be multiplied with each object. Subsequently, the PDG may be quantized by a quantization table identical to a CLD.

When the post downmix signal 102 is decoded by adjusting the post downmix signal to be similar to the downmix signal generated during an encoding operation, a sound quality may be significantly degraded than when decoding is performed directly using the downmix signal. Accordingly, the downmix information parameter used to adjust the post downmix signal 102 is to be efficiently extracted to reduce sound degradation. The downmix information parameter may be a parameter such as a CLD used as an Arbitrary Downmix Gain (ADG) of a Moving Picture Experts Group Surround (MPEG Surround) scheme.

The CLD parameter may be quantized for transmission, and may be symmetrical with respect to 0 dB, and thereby may reduce a quantization error and reduce sound degradation caused by the post downmix signal.

The bitstream generation unit 203 may combine the object information and the downmix information parameter, and generate an object bitstream.

Figure 3:
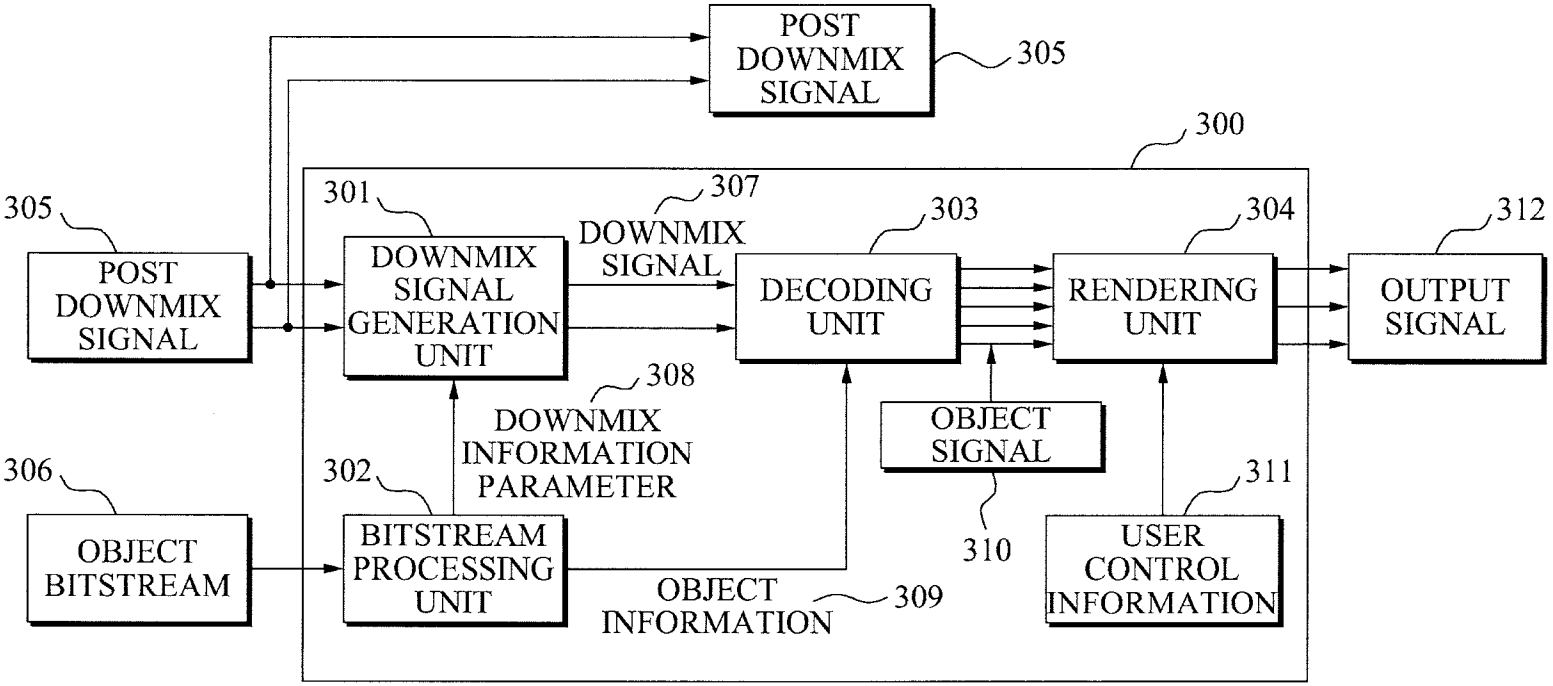
FIG. 3 is a block diagram illustrating a configuration of a multi-object audio decoding apparatus supporting a post downmix signal according to an embodiment of the present invention.

FIG. 3 is a block diagram illustrating a configuration of a multi-object audio decoding apparatus 300 supporting a post downmix signal according to an embodiment of the present invention.

Referring to FIG. 3, the multi-object audio decoding apparatus 300 may include a downmix signal generation unit 301, a bitstream processing unit 302, a decoding unit 303, and a rendering unit 304. The multi-object audio decoding apparatus 300 may support a post downmix signal 305 inputted from an outside.

The bitstream processing unit 302 may extract a downmix information parameter 308 and object information 309 from an object bitstream 306 transmitted from a multi-object audio encoding apparatus. Subsequently, the downmix signal generation unit 301 may adjust the post downmix signal 305 based on the downmix information parameter 308 and generate a downmix signal 307. In this instance, the downmix information parameter 308 may compensate for a signal strength difference between the downmix signal 307 and the post downmix signal 305.

The decoding unit 303 may decode the downmix signal 307 using the object information 309 and generate an object signal 310. The rendering unit 304 may perform rendering with respect to the generated object signal 310 using user control information 311 and generate a reproducible output signal 312. In this instance, the user control information 311 may indicate a rendering matrix or information required to generate an output signal by mixing restored object signals.

Figure 4:
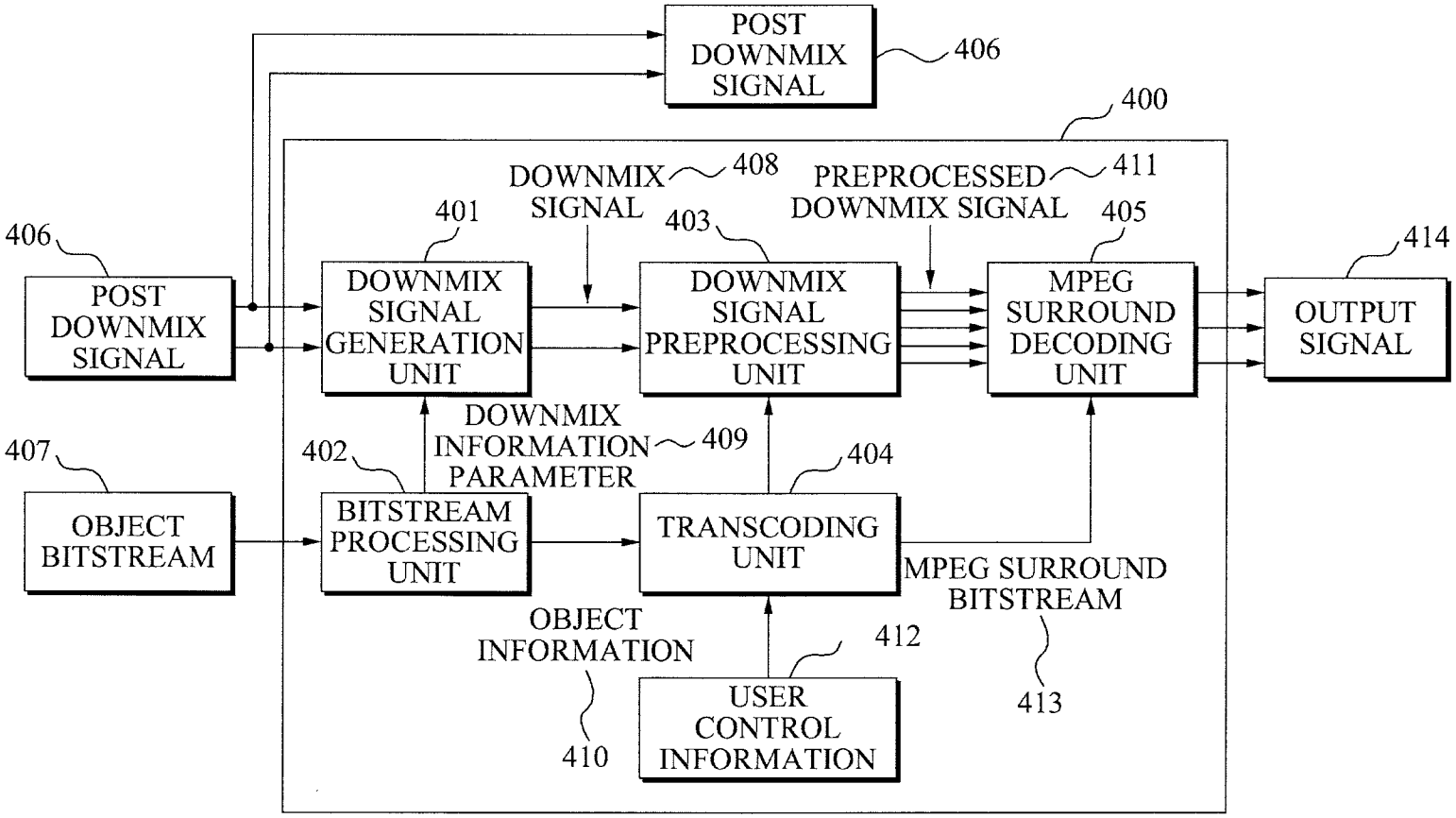
FIG. 4 is a block diagram illustrating a configuration of a multi-object audio decoding apparatus supporting a post downmix signal according to another embodiment of the present invention.

FIG. 4 is a block diagram illustrating a configuration of a multi-object audio decoding apparatus 400 supporting a post downmix signal according to another embodiment of the present invention.

Referring to FIG. 4, the multi-object audio decoding apparatus 400 may include a downmix signal generation unit 401, a bitstream processing unit 402, a downmix signal preprocessing unit 403, a transcoding unit 404, and an MPEG Surround decoding unit 405.

The bitstream processing unit 402 may extract a downmix information parameter 409 and object information 410 from an object bitstream 407. The downmix signal generation unit 410 may generate a downmix signal 408 using the downmix information parameter 409 and a post downmix signal 406. The post downmix signal 406 may be directly outputted for replay.

The transcoding unit 404 may perform transcoding with respect to the downmix signal 408 using the object information 410 and user control information 412. Subsequently, the downmix signal preprocessing unit 403 may preprocess the downmix signal 408 using a result of the transcoding. The MPEG Surround decoding unit 405 may perform MPEG Surround decoding using an MPEG Surround bitstream 413 and the preprocessed downmix signal 411. The MPEG Surround bitstream 413 may be the result of the transcoding. The multi-object audio decoding apparatus 400 may output an output signal 414 through an MPEG Surround decoding.

Figure 5:
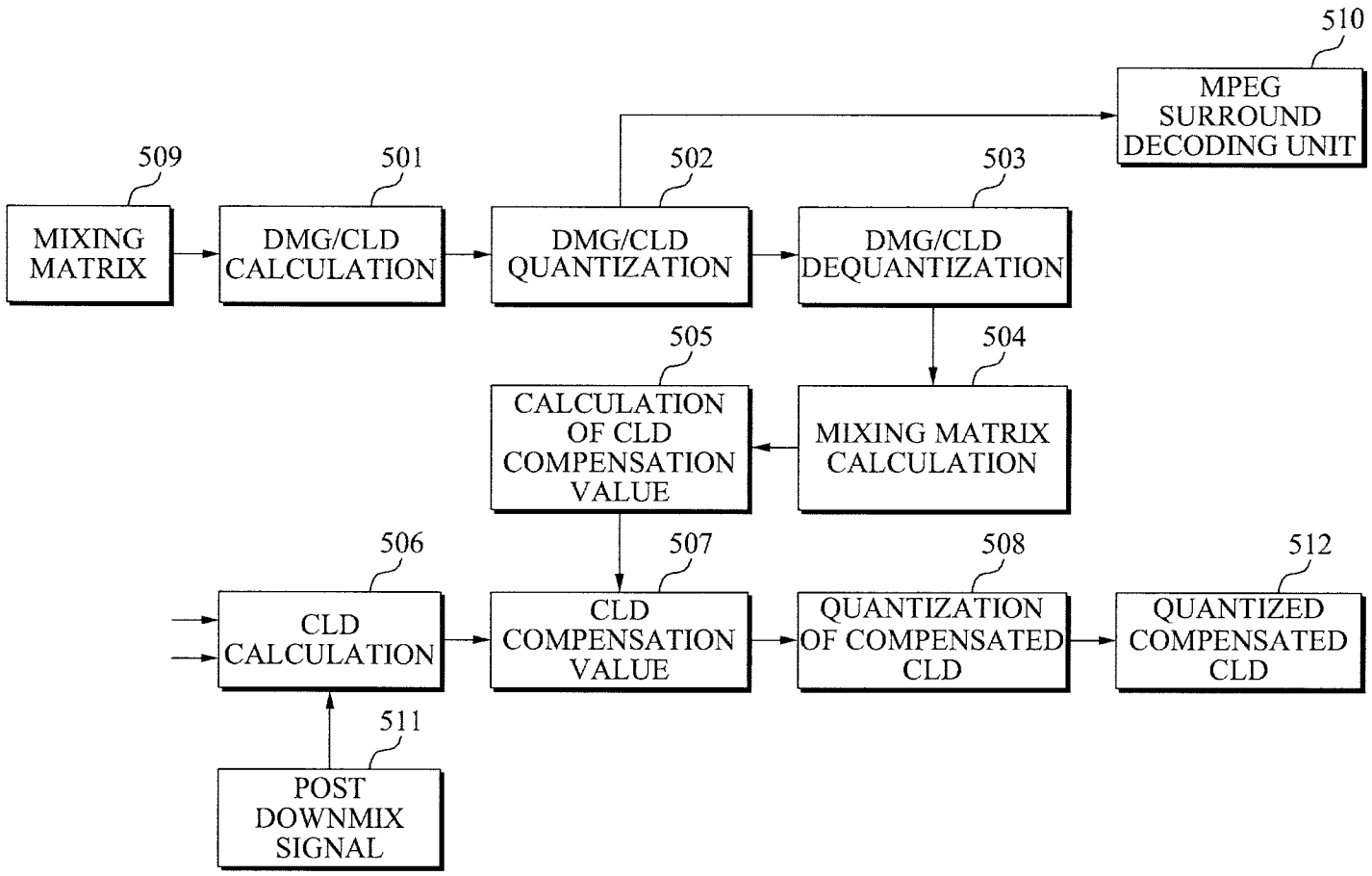
FIG. 5 is a diagram illustrating an operation of compensating for a Channel Level Difference (CLD) in a multi-object audio encoding apparatus supporting a post downmix signal according to an embodiment of the present invention.

FIG. 5 is a diagram illustrating an operation of compensating for a CLD in a multi-object audio encoding apparatus supporting a post downmix signal according to an embodiment of the present invention.

When decoding is performed by adjusting the post downmix signal to be similar to a downmix signal, a sound quality may be more significantly degraded than when decoding is performed by directly using the downmix signal generated during encoding. Accordingly, the post downmix signal is to be adjusted to be maximally similar to the original downmix signal to reduce the sound degradation. For this, a downmix information parameter used to adjust the post downmix signal is to be efficiently extracted and represented.

According to an embodiment of the present invention, a signal strength difference between the downmix signal and the post downmix signal may be used as the downmix information parameter. A CLD used as an ADG of an MPEG Surround scheme may be the downmix information parameter.

The downmix information parameter may be quantized by a CLD quantization table as shown in Table 1.

TABLE 1

| CLD quantization table | | | | | | | | |
|---|---|---|---|---|---|---|---|---|
| Quantization value (QV) | −150.0 | −45.0 | −40.0 | −35.0 | −30.0 | −25.0 | −22.0 | |
| Boundary value (BV) | — | −47.5 | −42.5 | −37.5 | −32.5 | −27.5 | −23.5 | — |
| QV | −22.0 | −19.0 | −16.0 | −13.0 | −10.0 | −8.0 | −6.0 | |
| BV | — | −20.5 | −17.5 | −14.5 | −11.5 | −9.0 | −7.0 | — |
| QV | −6.0 | −4.0 | −2.0 | 0.0 | 2.0 | 4.0 | 6.0 | |

TABLE 1-continued

| CLD quantization table | | | | | | | | |
|---|---|---|---|---|---|---|---|---|
| Quantization value (QV) | −150.0 | −45.0 | −40.0 | −35.0 | −30.0 | −25.0 | −22.0 | |
| Boundary value (BV) | — | −47.5 | −42.5 | −37.5 | −32.5 | −27.5 | −23.5 | — |
| BV | — | −5.0 | −3.0 | −1.0 | 1.0 | 3.0 | 5.0 | — |
| QV | 6.0 | 8.0 | 10.0 | 13.0 | 16.0 | 19.0 | 22.0 | |
| BV | — | 7.0 | 9.0 | 11.5 | 14.5 | 17.5 | 20.5 | — |
| QV | 22.0 | 25.0 | 30.0 | 35.0 | 40.0 | 45.0 | 150.0 | |
| BV | — | 23.5 | 27.5 | 32.5 | 37.5 | 42.5 | 47.5 | — |

Accordingly, when the downmix information parameter is symmetrically distributed with respect to 0 dB, a quantization error of the downmix information parameter may be reduced, and the sound degradation caused by the post downmix signal may be reduced.

However, a downmix information parameter associated with a post downmix signal and a downmix signal, generated in a general multi-object audio encoder, may be asymmetrically distributed due to a downmix gain for each object of a mixing matrix for the downmix signal generation. For example, when an original gain of each of the objects is 1, a downmix gain less than 1 may be multiplied with each of the objects to prevent distortion of a downmix signal due to clipping. Accordingly, the generated downmix signal may have a same small power as the downmix gain in comparison to the post downmix signal. In this instance, when the signal strength difference between the downmix signal and the post downmix signal is measured, a center of a distribution may not be located in 0 dB.

When the downmix information parameter is quantized as described above, the quantization error may be increased since only one side of the CLD quantization table shown above may be used. According to an embodiment of the present invention, the multi-object audio encoding apparatus may enable the center of the distribution of the parameter, extracted by compensating for the downmix information parameter, to be located adjacent to 0 dB, and perform quantization, which is described below.

A CLD, that is, a downmix information parameter between a post downmix signal, inputted from an outside, and a downmix signal, generated based on a mixing matrix of a channel X, in a particular frame/parameter band may be given by, $$CLD_X(n,k) = 10\log_{10}\frac{P_{X,m}(n,k)}{P_{X,d}(n,k)} \quad \text{[Equation 1]}$$

where n and k may denote a frame and a parameter band, respectively. Pm and Pd may denote a power of the post downmix signal and a power of the downmix signal, respectively. When a downmix gain for each object of a mixing matrix to generates the downmix signal of the channel X is GX1, GX2, . . . , GXN, a CLD compensation value to compensate for a center of a distribution of the extracted CLD to be 0, may be given by, $$CLD_{X,c} = 10\log_{10}\frac{N^2}{(G_{X,1}+G_{X,2}+G_{X,3}+\ldots+G_{X,N})^2} \quad \text{[Equation 2]}$$

where N may denote a total number of inputted objects. The downmix gain for each of the objects of the mixing matrix may be identical in all frames/parameter bands, the CLD compensation value of Equation 2 may be a constant. Accordingly, a compensated CLD may be obtained by subtracting the CLD compensation value of Equation 2 from the downmix information parameter of Equation 1, which is given according to Equation 3 as below.

$$CLD_{X,m}(n,k)=CLD_X(n,k)-CLD_{X,c} \quad \text{[Equation 3]}$$

The compensated CLD may be quantized according to Table 1, and transmitted to a multi-object audio decoding apparatus. Also, a statistical distribution of the compensated CLD may be located around 0 dB in comparison to a general CLD, that is, a characteristic of a Laplacian distribution as opposed to a Gaussian distribution is shown. Accordingly, a quantization table, where a range from −10 dB to +10 dB is divided more closely, as opposed to the quantization table of Table 1 may be applied to reduce the quantization error.

The multi-object audio encoding apparatus may calculate a downmix gain (DMG) and a Downmix Channel Level Difference (DCLD) according to Equations 4, 5, and 6 given as below, and may transmit the DMG and the DCLD to the multi-object audio decoding apparatus. The DMG may indicate a mixing amount of each of the objects. Specifically, both mono downmix signal and stereo downmix signal may be used.

$$DMG_i=20\log_{10}G_i \quad \text{[Equation 4]}$$

where i=1, 2, 3, . . . N (mono downmix).

$$DMG_i=10\log_{10}(G_{1i}^2+G_{2i}^2) \quad \text{[Equation 5]}$$

where i=1, 2, 3, . . . N (stereo downmix).

$$DCLD_i = 20\log_{10}\frac{G_{1i}}{G_{2i}} \quad \text{[Equation 6]}$$

where i=1, 2, 3, . . . N.

Equation 4 may be used to calculate the downmix gain when the downmix signal is the mono downmix signal, and Equation 5 may be used to calculate the downmix gain when the downmix signal is the stereo downmix signal. Equation 6 may be used to calculate a degree each of the objects contributes to a left and right channel of the downmix signal. Here, $G_{1i}$, and $G_{2i}$, may denote the left channel and the right channel, respectively.

When supporting the post downmix signal according to an embodiment of the present invention, the mono downmix signal may not be used, and thus Equation 5 and Equation 6 may be applied. A compensation value like Equation 2 is to be calculated using Equation 5 and Equation 6 to restore the downmix information parameter using the transmitted compensated CLD and the downmix gain obtained using Equation 5 and Equation 6. A downmix gain for each of the objects with respect to the left channel and the right channel may be calculated using Equation 5 and Equation 6, which are given by, $$\hat{G}_{1i} = \sqrt{\frac{10^{DCLD_i/10}}{1+10^{DCLD_i/10}}} \cdot 10^{DMG_i/20} \quad \text{[Equation 7]}$$

$$\hat{G}_{2i} = \sqrt{\frac{1}{1+10^{DCLD_i/10}}} \cdot 10^{DMG_i/20}$$

where i=1, 2, 3 . . . , N

The CLD compensation value may be calculated in a same way as Equation 2 using the calculated downmix gain for each of the objects, which is given by, $$C\hat{L}D_{X,c} = 10\log_{10}\frac{N^2}{\left(\hat{G}_{X,1}+\hat{G}_{X,2}+\hat{G}_{X,3}+\ldots+\hat{G}_{X,N}\right)^2} \quad \text{[Equation 8]}$$

The multi-object audio decoding apparatus may restore the downmix information parameter using the calculated CLD compensation value and a dequantization value of the compensated CLD, which is given by, $$C\hat{L}D_{X,m}(n,k)=C\hat{L}D_X(n,k)+C\hat{L}D_{X,c} \quad \text{[Equation 9]}$$

A quantization error of the restored downmix information parameter may be reduced in comparison to a parameter restored through a general quantization process. Accordingly, sound degradation may be reduced.

An original downmix signal may be most significantly transformed during a level control process for each band through an equalizer. When an ADG of the MPEG Surround uses a CLD as a parameter, the CLD value may be processed as 20 bands or 28 bands, and the equalizer may use a variety of combinations such as 24 bands, 36 bands, and the like. A parameter band extracting the downmix information parameter may be set and processed as an equalizer band as opposed to a CLD parameter band, and thus an error of a resolution difference and difference between two bands may be reduced.

A downmix information parameter analysis band may be as below.

TABLE 2

| Downmix information parameter analysis band | |
|---|---|
| bsMDProcessingBand | Number of bands |
| 0 | Same as MPEG Surround CLD parameter band |
| 1 | 8 band |
| 2 | 16 band |
| 3 | 24 band |
| 4 | 32 band |
| 5 | 48 band |
| 6 | Reserved |

When a value of 'bsMDProcessingBand' is greater than 1, the downmix information parameter may be extracted as a separately defined band used by a general equalizer.

The operation of compensating for the CLD of FIG. 5 is described.

To process the post downmix signal, the multi-object audio encoding apparatus may perform a DMG/CLD calculation 501 using a mixing matrix 509 according to Equation 2. Also, the multi-object audio encoding apparatus may quantize the DMG/CLD through a DMG/CLD quantization 502, dequantize the DMG/CLD through a DMG/CLD dequantization 503, and perform a mixing matrix calculation 504. The multi-object audio encoding apparatus may perform a CLD compensation value calculation 505 using a mixing matrix, and thereby may reduce an error of the CLD.

Also, the multi-object audio encoding apparatus may perform a CLD calculation 506 using a post downmix signal 511. The multi-object audio encoding apparatus may perform a CLD quantization 508 using the CLD compensation value 507 calculated through the CLD compensation value calculation 505. Accordingly, a quantized compensated CLD 512 may be generated.

Figure 6:
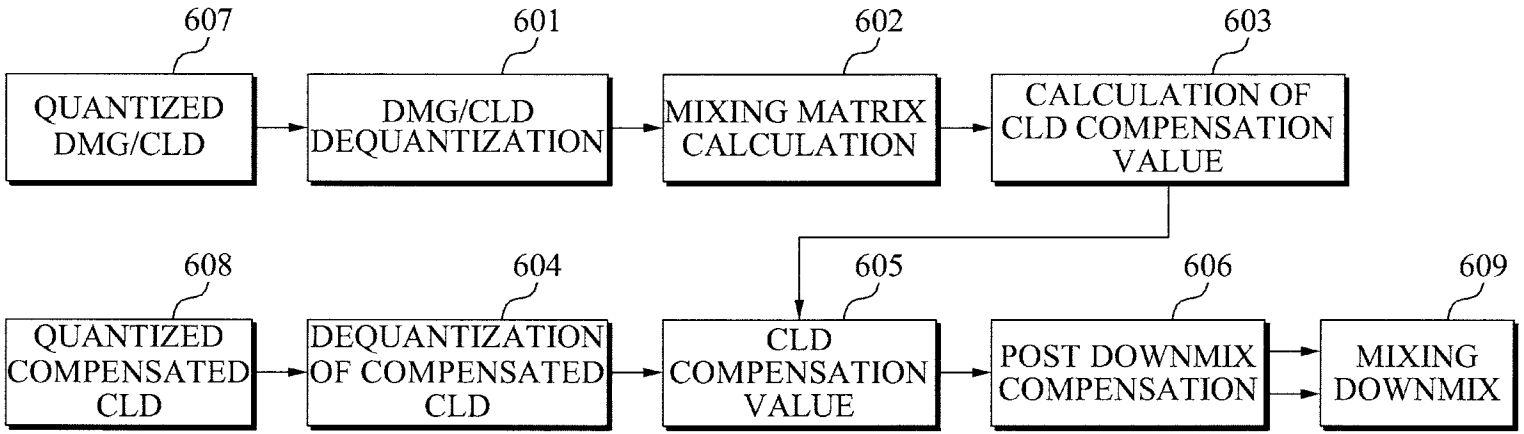
FIG. 6 is a diagram illustrating an operation of compensating for a post downmix signal through inversely compensating for a CLD compensation value according to an embodiment of the present invention.

FIG. 6 is a diagram illustrating an operation of compensating for a post downmix signal through inversely compensating for a CLD compensation value according to an embodiment of the present invention. The operation of FIG. 6 may be an inverse of the operation of FIG. 5.

A multi-object audio decoding apparatus may perform a DMG/CLD dequantization 601 using a quantized DMG/CLD 607. The multi-object audio decoding apparatus may perform a mixing matrix calculation 602 using the dequantized DMG/CLD, and perform a CLD compensation value calculation 603. The multi-object audio decoding apparatus may perform a dequantization 604 of a compensated CLD using a quantized compensated CLD 608. Also, the multi-object audio decoding apparatus may perform a post downmix compensation 606 using the dequantized compensated CLD and the CLD compensation value 605 calculated through the CLD compensation value calculation 603. A post downmix signal may be applied to the post downmix compensation 606. Accordingly, a mixing downmix 609 may be generated.

Figure 7:
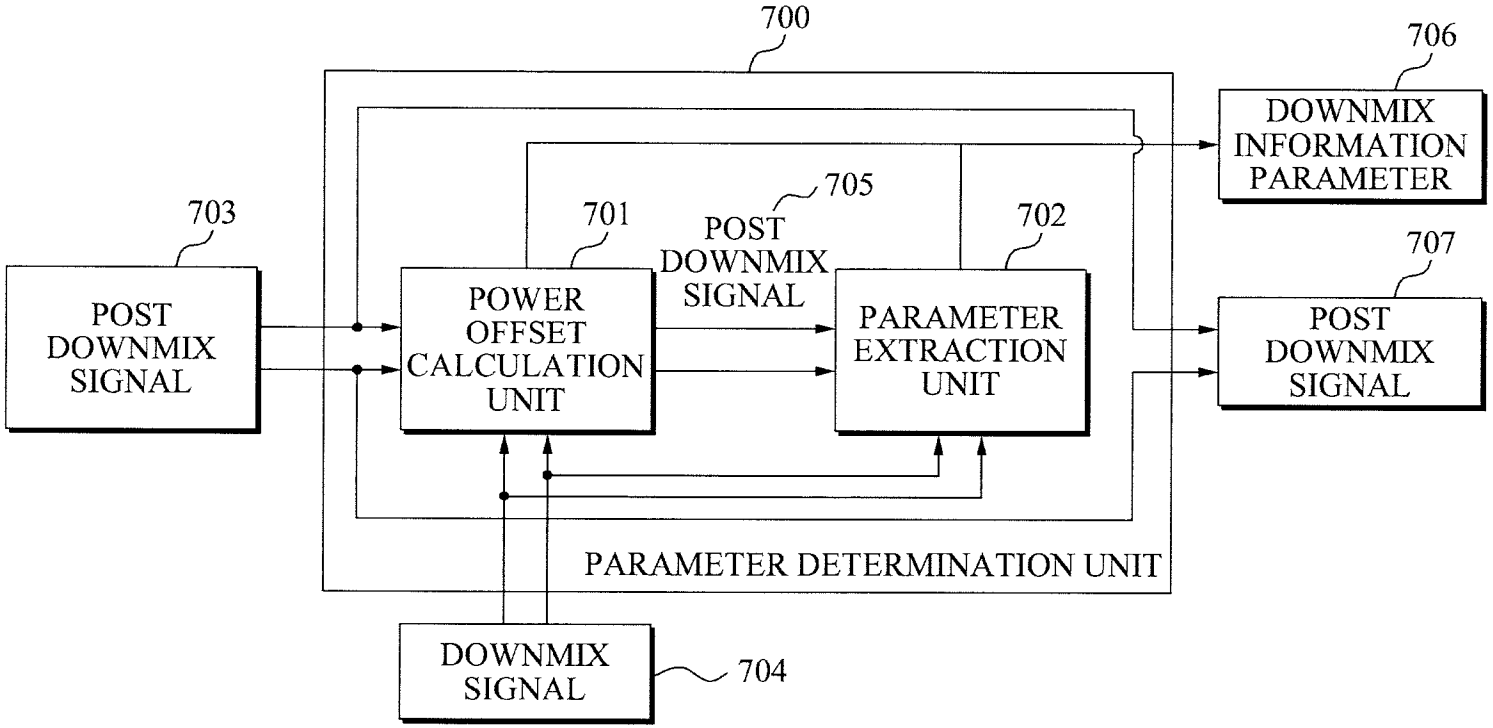
FIG. 7 is a block diagram illustrating a configuration of a parameter determination unit in a multi-object audio encoding apparatus supporting a post downmix signal according to another embodiment of the present invention.

FIG. 7 is a block diagram illustrating a configuration of a parameter determination unit 700 in a multi-object audio encoding apparatus supporting a post downmix signal according to another embodiment of the present invention.

Referring to FIG. 7, the parameter determination unit 700 may include a power offset calculation unit 701 and a parameter extraction unit 702. The parameter determination unit 700 may correspond to the parameter determination unit 202 of FIG. 2.

The power offset calculation unit 701 may scale the post downmix signal as a predetermined value to enable an average power of a post downmix signal 703 in a particular frame to be identical to an average power of a downmix signal 704. In general, since the post downmix signal 703 has a greater power than a downmix signal generated during an encoding operation, the power offset calculation unit 701 may adjust the power of the post downmix signal 703 and the downmix signal 704 through scaling.

The parameter extraction unit 702 may extract a downmix information parameter 706 from the scaled post downmix signal 705 in the particular frame. The post downmix signal 703 may be used to determine the downmix information parameter 706, or a post downmix signal 707 may be directly outputted without a particular process.

That is, the parameter determination unit 700 may calculate a signal strength difference between the downmix signal 704 and the post downmix signal 705 to determine the downmix information parameter 706. Specifically, the parameter determination unit 700 may determine a PDG as the downmix information parameter 706. The PDG may be evenly and symmetrically distributed by adjusting the post downmix signal 705 to be maximally similar to the downmix signal 704.

Figure 8:
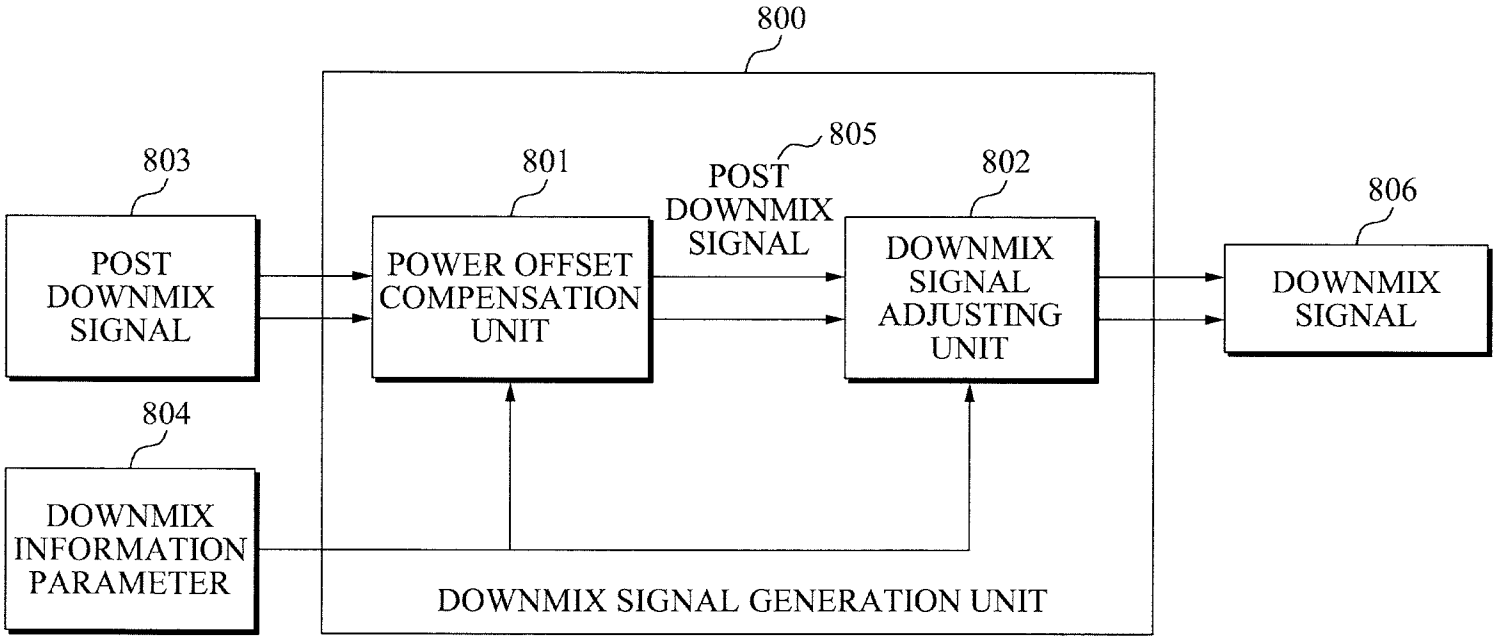
FIG. 8 is a block diagram illustrating a configuration of a downmix signal generation unit in a multi-object audio decoding apparatus supporting a post downmix signal according to another embodiment of the present invention.

FIG. 8 is a block diagram illustrating a configuration of a downmix signal generation unit 800 in a multi-object audio decoding apparatus supporting a post downmix signal according to another embodiment of the present invention.

Referring to FIG. 8, the downmix signal generation unit 800 may include a power offset compensation unit 801 and a downmix signal adjusting unit 802.

The power offset compensation unit 801 may scale a post downmix signal 803 using a power offset value extracted from a downmix information parameter 804. The power offset value may be included in the downmix information parameter 804, and may or may not be transmitted, as necessary.

The downmix signal adjusting unit 802 may convert the scaled post downmix signal 805 into a downmix signal 806.

Figure 9:
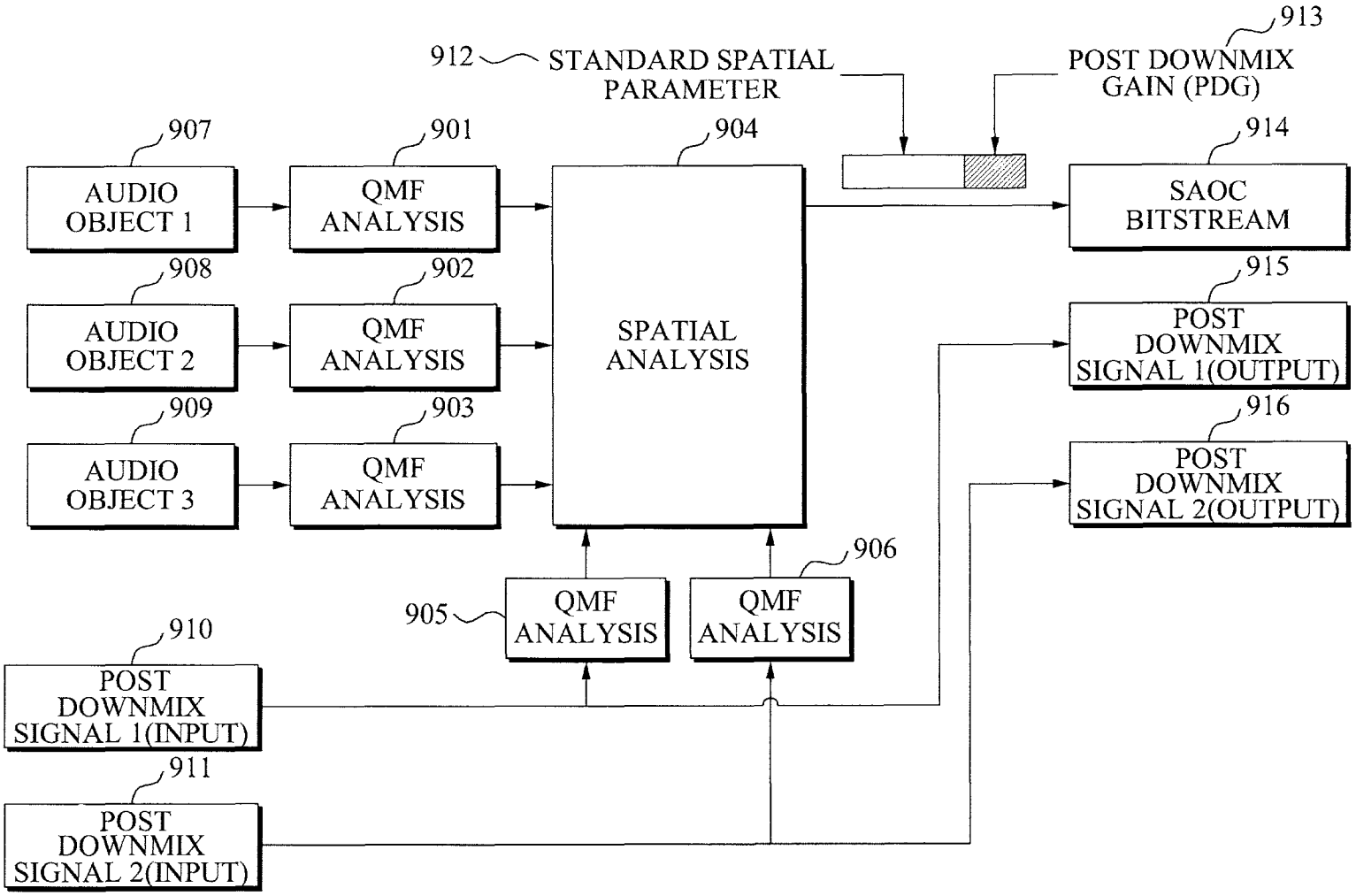
FIG. 9 is a diagram illustrating an operation of outputting a post downmix signal and a Spatial Audio Object Coding (SAOC) bitstream according to an embodiment of the present invention.

FIG. 9 is a diagram illustrating an operation of outputting a post downmix signal and a Spatial Audio Object Coding (SAOC) bitstream according to an embodiment of the present invention.

A syntax as shown in Table 3 through Table 7 may be added to apply a downmix information parameter to support the post downmix signal.

TABLE 3

Syntax of SAOCSpecificConfig( )

| Syntax | No. of bits | Mnemonic |
|---|---|---|
| SAOCSpecificConfig( ) | | |
| { | | |
| bsSamplingFrequencyIndex; | 4 | uimsbf |
| if ( bsSamplingFrequencyIndex == 15 ) { | | |

TABLE 3-continued

Syntax of SAOCSpecificConfig( )

| Syntax | No. of bits | Mnemonic |
|---|---|---|
| bsSamplingFrequency; | 24 | uimsbf |
| } | | |
| bsFreqRes; | 3 | uimsbf |
| bsFrameLength; | 7 | uimsbf |
| frameLength = bsFrameLength + 1; | | |
| bsNumObjects; | 5 | uimsbf |
| numObjects = bsNumObjects+1; | | |
| for ( i=0; i<numObjects; i++ ) { | | |
| bsRelatedTo[i][i] = 1; | | |
| for( j=i+1; j<numObjects; j++ ) { | | |
| bsRelatedTo[i]j]; | 1 | uimsbf |
| bsRelatedTo[j][i] = bsRelatedTo[i][j]; | | |
| } | | |
| } | | |
| bsTransmitAbsNrg; | 1 | uimsbf |
| bsNumDmxChannels; | 1 | uimsbf |
| numDmxChannels = bsNumDmxChannels + 1; | | |
| if ( numDmxChannels == 2 ) { | | |
| bsTttDualMode; | 1 | uimsbf |
| if(bsTttDualMode){ | | |
| bsTttBandsLow; | 5 | uimsbf |
| } | | |
| else { | | |
| bsTttBandsLow = numBands; | | |
| } | | |
| } | | |
| bsMasteringDownmix; | 1 | uimsbf |
| ByteAlign( ); | | |
| SAOCExtensionConfig( ); | | |
| } | | |

TABLE 4

Syntax of SAOCExtensionConfigData(1)

| Syntax | No. of bits | Mnemonic |
|---|---|---|
| SAOCExtensionConfigData(1) | | |
| { | | |
| bsMasteringDownmixResidualSampingFrequencyIndex; | 4 | uimsbf |
| bsMasteringDownmixResidualFramesPerSpatialFrame; | 2 | Uimsbf |
| bsMasteringDwonmixResidualBands; | 5 | Uimsbf |
| } | | |

TABLE 5

Syntax of SAOCFrame( )

| Syntax | No. of bits | Mnemonic |
|---|---|---|
| SAOCFrame( ) | | |
| { | | |
| FramingInfo( ); | | Note 1 |
| bsIndependencyFlag; | 1 | uimsbf |
| startBand = 0; | | |
| for( i=0; i<numObjects; i++ ) { | | |
| [old[i], oldQuantCoarse[i], oldFreqResStride[i]] = EcData(t_OLD,prevOldQuantCoarse[i], prevOldFreqResStride[i], numParamSets, bsIndependencyFlag, startBand, numBands ); | | Notes 2 |
| } | | |
| if ( bsTransmitAbsNrg ) { | | |
| [nrg, nrgQuantCoarse, nrgFreqResStride] = EcData( t_NRG, prevNrgQuantCoarse, prevNrgFreqResStride, numParamSets, bsIndependencyFlag, startBand, numBands ); | | Notes 2 |
| } | | |

TABLE 5-continued

| Syntax of SAOCFrame( ) | | |
|---|---|---|
| Syntax | No. of bits | Mnemonic |
| for( i=0; i<numObjects; i++ ) { | | |
| for( j=i+1; j<numObjects; j++ ) { | | |
| if ( bsRelatedTo[i][j] != 0 ) { | | |
| ioc[i][j], iocQuantCoarse[i][j], iocFreqResStride[i][j] = | | Notes 2 |
| EcData(t_ICC,prevIocQuantCoarse[i][j], prevIocFreqResStride[i][j], | | |
| numParamSets, bsIndependencyFlag, startBand, numBands ); | | |
| } | | |
| } | | |
| } | | |
| firstObject = 0; | | |
| [dmg, dmgQuantCoarse, dmgFreqResStride] = | | |
| EcData( t_CLD, prevDmgQuantCoarse, prevIocFreqResStride, | | |
| numParamSets, bsIndependencyFlag, firstObject, numObjects ); | | |
| if ( numDmxChannels > 1 ) { | | |
| [cld, cldQuantCoarse, cldFreqResStride] = | | |
| EcData( t_CLD, prevCldQuantCoarse, prevCldFreqResStride, | | |
| numParamSets, bsIndependencyFlag, firstObject, numObjects ); | | |
| } | | |
| if (bsMasteringDownmix ! = 0 ) { | | |
| for ( i=0; i<numDmxChannels;i++){ | | |
| EcData(t_CLD, prevMdgQuantCoarse[i], prevMdgFreqResStride[i], | | |
| numParamSets, , bsIndependencyFlag, startBand, numBands ); | | |
| } | | |
| ByteAlign( ); | | |
| SAOCExtensionFrame( ); | | |
| } | | |

Note 1:
FramingInfo( ) is defined in ISO/IEC 23003-1: 2007, Table 16.
Note 2:
EcData( ) is defined in ISO/IEC 23003-1: 2007, Table 23.

TABLE 6

| Syntax of SpatialExtensionFrameData(1) | | |
|---|---|---|
| Syntax | No. of bits | Mnemonic |
| SpatialExtensionDataFrame(1) | | |
| { | | |
| MasteringDownmixResidualData( ); | | |
| } | | |

TABLE 7

| Syntax of MasteringDownmixResidualData( ) | | |
|---|---|---|
| Syntax | No. of bits | Mnemonic |
| MasteringDownmixResidualData( ) | | |
| { | | |
| resFrameLength = numSlots / | | Note 1 |
| (bsMasteringDownmixResidualFramesPerSpatialFrame + 1); | | |
| for (i = 0; i < numAacEl; i++) { | | Note 2 |
| bsMasteringDownmixResidualAbs[i] | 1 | Uimsbf |
| bsMasteringDownmixResidualAlphaUpdateSet[i] | 1 | Uimsbf |
| for (rf = 0; rf < bsMasteringDownmixResidualFramesPerSpatialFrame + 1;rf++) | | |
| if (AacEl[i] == 0) { | | |
| individual_channel_stream(0); | | Note 3 |
| else{ | | Note 4 |
| channel_pair_element(); | | |
| } | | Note 5 |
| if (window_sequence == EIGHT_SHORT_SEQUENCE) && | | |
| ((resFrameLength == 18) ‖ (resFrameLength == 24) ‖ | | Note 6 |
| (resFrameLength == 30)) { | | |
| if (AacEl[i] = 0) { | | |
| individual_channel_stream(0); | | |
| else{ | | Note 4 |
| channel_pair_element( ); | | |

TABLE 7-continued

| Syntax of MasteringDownmixResidualData( ) | | |
|---|---|---|
| Syntax | No. of bits | Mnemonic |
| } | | Note 5 |
| } | | |
| } | | |
| } | | |
| } | | |
| } | | |

Note 1:
numSlots is defined by numSlots = bsFrameLength + 1. Furthermore the division shall be interpreted as ANSI C integer division.
Note 2:
numAacEl indicates the number of AAC elements
in the current frame according to Table 81 in ISO/IEC 23003-1.
Note 3:
AacEl indicates the type of each AAC element
in the current frame according to Table 81 in ISO/IEC 23003-1.
Note 4:
individual_channel_stream(0) according to MPEG-2 AAC Low Complexity profile bitstream syntax described in subclause 6.3 of ISO/IEC 13818-7.
Note 5:
channel_pair_element(); according to MPEG-2 AAC Low Complexity profile bitsream syntax described in subclause 6.3 of ISO/IEC 13818-7. The parameter common_window is set to 1.
Note 6:
The value of window_sequence is determined in individual_channel_stream(0) or channel_pair_element( ).

A post mastering signal may indicate an audio signal generated by a mastering engineer in a music field, and be applied to a general downmix signal in various fields associated with an MPEG-D SAOC such as a video conference system, a game, and the like. Also, an extended downmix signal, an enhanced downmix signal, a professional downmix, and the like may be used as a mastering downmix signal with respect to the post downmix signal. A syntax to support the mastering downmix signal of the MPEG-D SAOC, in Table 3 through Table 7, may be redefined for each downmix signal name as shown below.

TABLE 8

| Syntax of SAOCSpecificConfig( ) | | |
|---|---|---|
| Syntax | No. of bits | Mnemonic |
| SAOCSpecificConfig( ) | | |
| { | | |
| bsSamplingFrequencyIndex; | 4 | uimsbf |
| if ( bsSamplingFrequencyIndex == 15 ) { | | |
| bsSamplingFrequency; | 24 | uimsbf |
| } | | |
| bsFreqRes; | 3 | uimsbf |
| bsFrameLength; | 7 | uimsbf |
| frameLength = bsFrameLength + 1; | | |
| bsNumObjects; | 5 | uimsbf |

TABLE 8-continued

| Syntax of SAOCSpecificConfig( ) | | |
|---|---|---|
| Syntax | No. of bits | Mnemonic |
| numObjects = bsNumObjects+1; | | |
| for ( i=0; i<numObjects; i++ ) { | | |
| bsRelatedTo[i][i] = 1; | | |
| for( j=i+1; j<numObjects; j++ ) { | | |
| bsRelatedTo[i][j]; | 1 | uimsbf |
| bsRelatedTo[j][i] = bsRelatedTo[i][j]; | | |
| } | | |
| } | | |
| bsTransmitAbsNrg; | 1 | uimsbf |
| bsNumDmxChannels; | 1 | uimsbf |
| numDmxChannels = bsNumDmxChannels + 1; | | |
| if ( numDmxChannels == 2 ) { | | |
| ssTttDualMode; | 1 | uimsbf |
| if (bsTttDualMode) { | | |
| bsTttBandsLow; | 5 | uimsbf |
| } | | |
| else { | | |
| bsTttBandsLow = numBands; | | |
| } | | |
| } | | |
| bsExtendedDownmix; | 1 | uimsbf |
| ByteAlign( ); | | |
| SAOCExtensionConfig( ); | | |
| } | | |

TABLE 9

| Syntax of SAOCExtensionConfigData(1) | | |
|---|---|---|
| Syntax | No. of bits | Mnemonic |
| SAOCExtensionConfigData(1) | | |
| { | | |
| bsExtendedDownmixResidualSampingFrequencyIndex; | 4 | uimsbf |
| bsExtendedDownmixResidualFramesPerSpatialFrame; | 2 | Uimsbf |
| bsExtendedDwonmixResidualBands; | 5 | Uimsbf |
| } | | |

TABLE 10

Syntax of SAOCFrame( )

| Syntax | No. of bits | Mnemonic |
|---|---|---|
| SAOCFrame( ) | | |
| { | | |
| FramingInfo( ); | | Note 1 |
| bsIndependencyFlag; | 1 | uimsbf |
| startBand = 0; | | |
| for( i=0; i<numObjects; i++ ) { | | |
| [old[i], oldQuantCoarse[i], oldFreqResStride[i]] = | | Notes 2 |
| EcData(t_OLD,prevOldQuantCoarse[i], prevOldFreqResStride[i], | | |
| numParamSets, bsIndependencyFlag, startBand, numBands ); | | |
| } | | |
| if ( bsTransmitAbsNrg ) { | | |
| [nrg, nrgQuantCoarse, nrgFreqResStride] = | | Notes 2 |
| EcData( t_NRG, prevNrgQuantCoarse, prevNrgFreqResStride, | | |
| numParamSets, bsIndependencyFlag, startBand, numBands ); | | |
| } | | |
| for( i=0; i<numObjects; i++ ) { | | |
| for( j=i+1; j<numObjects; j++ ) { | | |
| if(bsRelatedTo[i][j] != 0 ) { | | |
| [ioc[i][j], iocQuantCoarse[i][j], iocFreqResStride[i][j] = | | Notes 2 |
| EcData(t_ICC,prevIocQuantCoarse[i][j], prevIocFreqResStride[i][j], | | |
| numParamSets, bsIndependencyFlag, startBand, numBands ); | | |
| } | | |
| } | | |
| } | | |
| firstObject = 0; | | |
| [dmg, dmgQuantCoarse, dmgFreqResStride] = | | |
| EcData( t_CLD, prevDmgQuantCoarse, prevIocFreqResStride, | | |
| numParamSets, bsIndependencyFlag, firstObject, numObjects ); | | |
| if ( numDmxChannels > 1 ) { | | |
| [cld, cldQuantCoarse, cldFreqResStride] = | | |
| EcData( t_CLD, prevCldQuantCoarse, prevCldFreqResStride, | | |
| numParamSets, bsIndependencyFlag, firstObject, numObjects ); | | |
| } | | |
| if (bsExtendedDownmix ! = 0 ) { | | |
| for ( i=0; i<numDmxChannels;i++){ | | |
| EcData(t_CLD, prevMdgQuantCoarse[i], prevMdgFreqResStride[i], | | |
| numParamSets, , bsIndependencyFlag, startBand, numBands ); | | |
| } | | |
| ByteAlign( ); | | |
| SAOCExtensionFrame( ); | | |
| } | | |

Note 1:
FramingInfo( ) is defined in ISO/IEC 23003-1: 2007, Table 16.
Note 2:
EcData( ) is defined in ISO/IEC 23003-1: 2007, Table 23.

TABLE 11

Syntax of SpatialExtensionFrameData(1)

| Syntax | No. of bits | Mnemonic |
|---|---|---|
| SpatialExtensionDataFrame(1) | | |
| { | | |
| ExtendedDownmixResidualData( ); | | |
| } | | |

TABLE 12

Syntax of ExtendedDownmixResidualData( )

| Syntax | No. of bits | Mnemonic |
|---|---|---|
| ExtendedDownmixResidualData( ) | | |
| { | | |
| resFrameLength = numSlots / | | Note 1 |
| (bsExtendedDownmixResidualFramesPerSpatialFrame + 1); | | |
| for (i = 0; i < numAacEl; i++) { | | Note 2 |

TABLE 12-continued

| Syntax of ExtendedDownmixResidualData( ) | | |
|---|---|---|
| Syntax | No. of bits | Mnemonic |
| bsExtendedDownmixResidualAbs[i] | 1 | Uimsbf |
| bsExtendedDownmixResidualAlphaUpdateSet[i] | 1 | Uimsbf |
| for (rf = 0; rf < bsExtendedDownmixResidualFramesPerSpatialFrame + 1;rf++) | | |
| if (AacEl[i] == 0) { | | |
| individual_channel_stream(0); | | Note 3 |
| else{ | | Note 4 |
| channel_pair_element( ); | | |
| } | | Note 5 |
| if (window_sequence == EIGHT_SHORT_SEQUENCE) && | | |
| ((resFrameLength = 18) ‖ (resFrameLength == 24) ‖ | | Note 6 |
| (resFrameLength == 30)) { | | |
| if (AacEl[i] == 0) { | | |
| individual_channel_stream(0); | | |
| else{ | | Note 4 |
| channel_pair_element( ); | | |
| } | | Note 5 |
| } | | |
| } | | |
| } | | |
| } | | |

Note 1:
numSlots is defined by numSlots = bsFrameLength + 1. Furthermore the division shall be interpreted as ANSI C integer division.
Note 2:
numAacEl indicates the number of AAC elements in the current frame according to Table 81 in ISO/IEC 23003-1.
Note 3:
AacEl indicates the type of each AAC element in the current frame according to Table 81 in ISO/IEC 23003-1.
Note 4:
individual_channel_stream(0) according to MPEG-2 AAC Low Complexity profile bitstream syntax described in subclause 6.3 of ISO/IEC 13818-7.
Note 5:
channel_pair_element( ); according to MPEG-2 AAC Low Complexity profile bitsream syntax described in subclause 6.3 of ISO/IEC 13818-7. The parameter common_window is set to 1.
Note 6:
The value of window_sequence is determined in individual_channel_stream(0) or channel_pair_element( ).

TABLE 13

| Syntax of SAOCSpecificConfig( ) | | |
|---|---|---|
| Syntax | No. of bits | Mnemonic |
| SAOCSpecificConfig( ) | | |
| { | | |
| bsSamplingFrequencyIndex; | 4 | uimsbf |
| if ( bsSamplingFrequencyIndex == 15 ) { | | |
| bsSamplingFrequency; | 24 | uimsbf |
| } | | |
| bsFreqRes; | 3 | uimsbf |
| bsFrameLength; | 7 | uimsbf |
| frameLength = bsFrameLength + 1; | | |
| bsNumObjects; | 5 | uimsbf |
| numObjects = bsNumObjects+1; | | |
| for ( i=0; i<numObjects; i++ ) { | | |
| bsRelatedTo[i][i] = 1; | | |
| for( j=i+1; j<numObjects; j++ ) { | | |
| bsRelatedTo[i][j]; | 1 | uimsbf |
| bsRelatedTo[j][i] = bsRelatedTo[i][j]; | | |
| } | | |
| } | | |

TABLE 13-continued

| Syntax of SAOCSpecificConfig( ) | | |
|---|---|---|
| Syntax | No. of bits | Mnemonic |
| bsTransmitAbsNrg; | 1 | uimsbf |
| bsNumDmxChannels; | 1 | uimsbf |
| numDmxChannels = bsNumDmxChannels + 1; | | |
| if ( numDmxChannels == 2 ) { | | |
| bsTttDualMode; | 1 | uimsbf |
| if (bsTttDualMode) { | | |
| bsTttBandsLow; | 5 | uimsbf |
| } | | |
| else { | | |
| bsTttBandsLow = numBands; | | |
| } | | |
| } | | |
| bsEnhancedDownmix; | 1 | uimsbf |
| ByteAlign( ); | | |
| SAOCExtensionConfig( ); | | |
| } | | |

TABLE 14

| Syntax of SAOCExtensionConfigData(1) | | |
|---|---|---|
| Syntax | No. of bits | Mnemonic |
| SAOCExtensionConfigData(1) | | |
| { | | |
| bsEnhancedDownmixResidualSampingFrequencyIndex; | 4 | uimsbf |
| bsEnhancedDownmixResidualFramesPerSpatialFrame; | 2 | Uimsbf |

TABLE 14-continued

| Syntax of SAOCExtensionConfigData(1) | | |
|---|---|---|
| Syntax | No. of bits | Mnemonic |
| bsEnhancedDwonmixResidualBands; | 5 | Uimsbf |
| } | | |

TABLE 15

| Syntax of SAOCFrame( ) | | |
|---|---|---|
| Syntax | No. of bits | Mnemonic |
| SAOCFrame( ) | | |
| { | | |
| FramingInfo( ); | | Note 1 |
| bsIndependencyFlag; | 1 | uimsbf |
| startBand = 0; | | |
| for( i=0; i<numObjects; i++ ) { | | |
| [old[i], oldQuantCoarse[i], oldFreqResStride[i]] = | | Notes 2 |
| EcData(t_OLD,prevOldQuantCoarse[i], prevOldFreqResStride[i], | | |
| numParamSets, bsIndependencyFlag, startBand, numBands ); | | |
| } | | |
| if ( bsTransmitAbsNrg ) { | | |
| [nrg, nrgQuantCoarse, nrgFreqResStride] = | | Notes 2 |
| EcData( t_NRG, prevNrgQuantCoarse, prevNrgFreqResStride, | | |
| numParamSets, bsIndependencyFlag, startBand, numBands ); | | |
| } | | |
| for( i=0; i<numObjects; i++ ) { | | |
| for( j=i+1; j<numObjects; j++) { | | |
| if ( bsRelatedTo[i][j] != 0 ) { | | |
| [ioc[i][j], iocQuantCoarse[i][j], iocFreqResStride[i][j] = | | Notes 2 |
| EcData(t_ICC,prevIocQuantCoarse[i][j], prevIocFreqResStride[i][j], | | |
| numParamSets, bsIndependencyFlag, startBand, numBands ); | | |
| } | | |
| } | | |
| } | | |
| firstObject = 0; | | |
| [dmg, dmgQuantCoarse, dmgFreqResStride] = | | |
| EcData( t_CLD, prevDmgQuantCoarse, prevIocFreqResStride, | | |
| numParamSets, bsIndependencyFlag, firstObject, numObjects ); | | |
| if ( numDmxChannels > 1 ) { | | |
| [cld, cldQuantCoarse, cldFreqResStride] = | | |
| EcData( t_CLD, prevCldQuantCoarse, prevCldFreqResStride, | | |
| numParamSets, bsIndependencyFlag, firstObject, numObjects ); | | |
| } | | |
| if (bsEnhancedDownmix ! = 0 ) { | | |
| for ( i=0; i<numDmxChannels;i++){ | | |
| EcData(t_CLD, prevMdgQuantCoarse[i], prevMdgFreqResStride[i], | | |
| numParamSets, , bsIndependencyFlag, startBand, numBands ); | | |
| } | | |
| ByteAlign( ); | | |
| SAOCExtensionFrame( ); | | |
| } | | |

Note 1:
FramingInfo( ) is defined in ISO/IEC 23003-1: 2007, Table 16.
Note 2:
EcData( ) is defined in ISO/IEC 23003-1: 2007, Table 23.

TABLE 16

| Syntax of SpatialExtensionFrameData(1) | | |
|---|---|---|
| Syntax | No. of bits | Mnemonic |
| SpatialExtensionDataFrame(1) | | |
| { | | |
| EnhancedDownmixResidualData( ); | | |
| } | | |

TABLE 17

Syntax of EnhancedDownmixResidualData( )

| Syntax | No. of bits | Mnemonic |
|---|---|---|
| EnhancedDownmixResidualData( ) | | |
| { | | |
| resFrameLength = numSlots / | | Note 1 |
| (bsEnhancedDownmixResidualFramesPerSpatialFrame + 1); | | |
| for (i = 0; i < numAacEl; i++) { | | Note 2 |
| bsEnhancedDownmixResidualAbs[i] | 1 | Uimsbf |
| bsEnhancedDownmixResidualAlphaUpdateSet[i] | 1 | Uimsbf |
| for (rf = 0; rf < bsEnhancedDownmixResidualFramesPerSpatialFrame + 1;rf++) | | |
| if (AacEl[i] == 0) { | | |
| individual_channel_stream(0); | | Note 3 |
| else{ | | Note 4 |
| channel_pair_element( ); | | |
| } | | Note 5 |
| if (window_sequence == EIGHT_SHORT_SEQUENCE) && | | |
| ((resFrameLength == 18) ‖ (resFrameLength == 24) ‖ | | Note 6 |
| (resFrameLength == 30)) { | | |
| if (AacEl[i] == 0) { | | |
| individual_channel_stream(0); | | |
| else{ | | Note 4 |
| channel_pair_element( ); | | |
| } | | Note 5 |
| } | | |
| } | | |
| } | | |
| } | | |

Note 1:
numSlots is defined by numSlots = bsFrameLength + 1. Furthermore the division shall be interpreted as ANSI C integer division.

Note 2:
numAacEl indicates the number of AAC elements in the current frame according to Table 81 in ISO/IEC 23003-1.

Note 3:
AacEl indicates the type of each AAC element in the current frame according to Table 81 in ISO/IEC 23003-1.

Note 4:
individual_channel_stream(0) according to MPEG-2 AAC Low Complexity profile bitstream syntax described in subclause 6.3 of ISO/IEC 13818-7.

Note 5:
channel_pair_element( ); according to MPEG-2 AAC Low Complexity profile bitsream syntax described in subclause 6.3 of ISO/IEC 13818-7. The parameter common_window is set to 1.

Note 6:
The value of window_sequence is determined in individual_channel_stream(0) or channel_pair_element( ).

TABLE 18

Syntax of SAOCSpecificConfig( )

| Syntax | No. of bits | Mnemonic |
|---|---|---|
| SAOCSpecificConfig( ) | | |
| { | | |
| bsSamplingFrequencyIndex; | 4 | uimsbf |
| if ( bsSamplingFrequencyIndex == 15 ) { | | |
| bsSamplingFrequency; | 24 | uimsbf |
| } | | |
| bsFreqRes; | 3 | uimsbf |
| bsFrameLength; | 7 | uimsbf |
| frameLength = bsFrameLength + 1; | | |
| bsNumObjects; | 5 | uimsbf |
| numObjects = bsNumObjects+1; | | |
| for ( i=0; i<numObjects; i++ ) { | | |
| bsRelatedTo[i][i] = 1; | | |
| for( j=i+1; j<numObjects; j++ ) { | | |
| bsRelatedTo[i][j]; | 1 | uimsbf |
| bsRelatedTo[j][i] = bsRelatedTo[i][j]; | | |
| } | | |
| } | | |
| bsTransmitAbsNrg; | 1 | uimsbf |

TABLE 18-continued

Syntax of SAOCSpecificConfig( )

| Syntax | No. of bits | Mnemonic |
|---|---|---|
| bsNumDmxChannels; | 1 | uimsbf |
| numDmxChannels = bsNumDmxChannels + 1; | | |
| if ( numDmxChannels == 2 ) { | | |
| bsTttDualMode; | 1 | uimsbf |
| if (bsTttDualMode) { | | |
| bsTttBandsLow; | 5 | uimsbf |
| } | | |
| else { | | |
| bsTttBandsLow = numBands; | | |
| } | | |
| } | | |
| bsProfessionalDownmix; | 1 | uimsbf |
| ByteAlign( ); | | |
| SAOCExtensionConfig( ); | | |
| } | | |

TABLE 19

| Syntax of SAOCExtensionConfigData(1) | | |
|---|---|---|
| Syntax | No. of bits | Mnemonic |
| SAOCExtensionConfigData(1) | | |
| { | | |
| bsProfessionalDownmixResidualSampingFrequencyIndex; | 4 | uimsbf |
| bsProfessionalDownmixResidualFramesPerSpatialFrame; | 2 | Uimsbf |
| bsProfessionalDwonmixResidualBands; | 5 | Uimsbf |
| } | | |

TABLE 20

| Syntax of SAOCFrame( ) | | |
|---|---|---|
| Syntax | No. of bits | Mnemonic |
| SAOCFrame( ) | | |
| { | | |
| FramingInfo( ); | | Note 1 |
| bsIndependencyFlag; | 1 | uimsbf |
| startBand = 0; | | |
| for( i=0; i<numObjects; i++ ) { | | |
| [old[i], oldQuantCoarse[i], oldFreqResStride[i]] = | | Notes 2 |
| EcData(t_OLD,prevOldQuantCoarse[i], prevOldFreqResStride[i], | | |
| numParamSets, bsIndependencyFlag, startBand, numBands ); | | |
| } | | |
| if ( bsTransmitAbsNrg ) { | | |
| [nrg, nrgQuantCoarse, nrgFreqResStride] = | | Notes 2 |
| EcData( t_NRG, prevNrgQuantCoarse, prevNrgFreqResStride, | | |
| numParamSets, bsIndependencyFlag, startBand, numBands ); | | |
| } | | |
| for( i=0; i<numObjects; i++ ) { | | |
| for( j=i+1; j<numObjects; j++ ) { | | |
| if (bsRelatedTo[i][j] != 0 ) { | | |
| {ioc[i][j], iocQuantCoarse[i][j], iocFreqResStride[i][j] = | | Notes 2 |
| EcData(t_ICC,prevIocQuantCoarse[i][j], prevIocFreqResStride[i][j], | | |
| numParamSets, bsIndependencyFlag, startBand, numBands ); | | |
| } | | |
| } | | |
| } | | |
| firstObject = 0; | | |
| [dmg, dmgQuantCoarse, dmgFreqResStride] = | | |
| EcData( t_CLD, prevDmgQuantCoarse, prevIocFreqResStride, | | |
| numParamSets, bsIndependencyFlag, firstObject, numObjects ); | | |
| if ( numDmxChannels > 1 ) { | | |
| [cld, cldQuantCoarse, cldFreqResStride] = | | |
| EcData( t_CLD, prevCldQuantCoarse, prevCldFreqResStride, | | |
| numParamSets, bsIndependencyFlag, firstObject, numObjects ); | | |
| } | | |
| if (bsProfessionalDownmix ! = 0 ) { | | |
| for ( i=0; i<numDmxChannels;i++){ | | |
| EcData(t_CLD, prevMdgQuantCoarse[i], prevMdgFreqResStride[i], | | |
| numParamSets, , bsIndependencyFlag, startBand, numBands ); | | |
| } | | |
| ByteAlign( ); | | |
| SAOCExtensionFrame( ); | | |
| } | | |

Note 1:
FramingInfo( ) is defined in ISO/IEC 23003-1: 2007, Table 16.
Note 2:
EcData( ) is defined in ISO/IEC 23003-1: 2007, Table 23.

TABLE 21

| Syntax of SpatialExtensionFrameData(1) | | |
|---|---|---|
| Syntax | No. of bits | Mnemonic |
| SpatialExtensionDataFrame(1) | | |
| { | | |

TABLE 21-continued

| Syntax of SpatialExtensionFrameData(1) | | |
|---|---|---|
| Syntax | No. of bits | Mnemonic |
| ProfessionalDownmixResidualData( ); | | |
| } | | |

TABLE 22

Syntax of ProfessionalDownmixResidualData( )

| Syntax | No. of bits | Mnemonic |
|---|---|---|
| ProfessionalDownmixResidualData( ) | | |
| { | | |
| resFrameLength = numSlots / | | Note 1 |
| (bsProfessionalDownmixResidualFramesPerSpatialFrame +1); | | |
| for (i = 0; i < numAacEl; i++) { | | Note 2 |
| bsProfessionalDownmixResidualAbs[i] | 1 | Uimsbf |
| bsProfessionalDownmixResidualAlphaUpdateSet[i] | 1 | Uimsbf |
| for (rf = 0; rf < bsProfessionalDownmixResidualFramesPerSpatialFrame + 1;rf++) | | |
| if (AacEl[i] == 0) { | | |
| individual_channel_stream(0); | | Note 3 |
| else{ | | Note 4 |
| channel_pair_element( ); | | |
| } | | Note 5 |
| if (window_sequence == EIGHT_SHORT_SEQUENCE) && | | |
| ((resFrameLength == 18) ‖ (resFrameLength == 24) ‖ | | Note 6 |
| (resFrameLength == 30)) { | | |
| if (AacEl[i] == 0) { | | |
| individual_channel_stream(0); | | |
| else{ | | Note 4 |
| channel_pair_element( ); | | |
| } | | Note 5 |
| } | | |
| } | | |
| } | | |
| } | | |

Note 1:
numSlots is defined by numSlots = bsFrameLength + 1. Furthermore the division shall be interpreted as ANSI C integer division.
Note 2:
numAacEl indicates the number of AAC elements in the current frame according to Table 81 in ISO/IEC 23003-1.
Note 3:
AacEl indicates the type of each AAC element in the current frame according to Table 81 in ISO/IEC 23003-1.
Note 4:
individual_channel_stream(0) according to MPEG-2 AAC Low Complexity profile bitstream syntax described in subclause 6.3 of ISO/IEC 13818-7.
Note 5:
channel_pair_element(); according to MPEG-2 AAC Low Complexity profile bitsream syntax described in subclause 6.3 of ISO/IEC 13818-7. The parameter common_window is set to 1.
Note 6:
The value of window_sequence is determined in individual_channel_stream(0) or channel_pair_element( ).

TABLE 23

Syntax of SAOCSpecificConfig( )

| Syntax | No. of bits | Mnemonic |
|---|---|---|
| SAOCSpecificConfig( ) | | |
| { | | |
| bsSamplingFrequencyIndex; | 4 | uimsbf |
| if ( bsSamplingFrequencyIndex == 15 ) { | | |
| bsSamplingFrequency; | 24 | uimsbf |
| } | | |
| bsFreqRes; | 3 | uimsbf |
| bsFrameLength; | 7 | uimsbf |
| frameLength = bsFrameLength + 1; | | |
| bsNumObjects; | 5 | uimsbf |
| numObjects = bsNumObjects+1; | | |
| for ( i=0; i<numObjects; i++ ) { | | |
| bsRelatedTo[i][i] = 1; | | |
| for( j=i+1; j<numObjects; j++ ) { | | |
| bsRelatedTo[i][j]; | 1 | uimsbf |
| bsRelatedTo[j][i] = bsRelatedTo[i][j]; | | |
| } | | |
| } | | |
| bsTransmitAbsNrg; | 1 | uimsbf |
| bsNumDmxChannels; | 1 | uimsbf |
| numDmxChannels = bsNumDmxChannels + 1; | | |
| if ( numDmxChannels == 2 ) { | | |
| bsTttDualMode; | 1 | uimsbf |
| if (bsTttDualMode) { | | |
| bsTttBandsLow; | 5 | uimsbf |
| } | | |

TABLE 23-continued

Syntax of SAOCSpecificConfig( )

| Syntax | No. of bits | Mnemonic |
|---|---|---|
| else { | | |
| bsTttBandsLow = numBands; | | |
| } | | |
| } | | |
| bsPostDownmix; | 1 | uimsbf |
| ByteAlign( ); | | |
| SAOCExtensionConfig( ); | | |
| } | | |

TABLE 24

Syntax of SAOCExtensionConfigData(1)

| Syntax | No. of bits | Mnemonic |
|---|---|---|
| SAOCExtensionConfigData(1) | | |
| { | | |
| bsPostDownmixResidualSampingFrequencyIndex; | 4 | uimsbf |
| bsPostDownmixResidualFramesPerSpatialFrame; | 2 | Uimsbf |
| bsPostDwonmixResidualBands; | 5 | Uimsbf |
| } | | |

TABLE 25

| Syntax of SAOCFrame( ) | | |
|---|---|---|
| Syntax | No. of bits | Mnemonic |
| SAOCFrame( ) | | |
| { | | |
| FramingInfo( ); | | Note 1 |
| bsIndependencyFlag; | 1 | uimsbf |
| startBand = 0; | | |
| for( i=0; i<numObjects; i++ ) { | | |
| [old[i], oldQuantCoarse[i], oldFreqResStride[i]] = | | Notes 2 |
| EcData(t_OLD,prevOldQuantCoarse[i], prevOldFreqResStride[i], | | |
| numParamSets, bsIndependencyFlag, startBand, numBands ); | | |
| } | | |
| if ( bsTransmitAbsNrg ) { | | |
| [nrg, nrgQuantCoarse, nrgFreqResStride] = | | Notes 2 |
| EcData( t_NRG, prevNrgQuantCoarse, prevNrgFreqResStride, | | |
| numParamSets, bsIndependencyFlag, startBand, numBands ); | | |
| } | | |
| for( i=0; i<numObjects; i++ ) { | | |
| for( j=i+1; j<numObjects; j++ ) { | | |
| if ( bsRelatedTo[i][j] != 0 ) { | | |
| [ioc[i][j], iocQuantCoarse[i][j], iocFreqResStride[i][j] = | | Notes 2 |
| EcData(t_ICC,prevIocQuantCoarse[i][j], prevIocFreqResStride[i][j], | | |
| numParamSets, bsIndependencyFlag, startBand, numBands ); | | |
| } | | |
| } | | |
| } | | |
| firstObject = 0; | | |
| dmg, dmgQuantCoarse, dmgFreqResStride] = | | |
| EcData( t_CLD, prevDmgQuantCoarse, prevIocFreqResStride, | | |
| numParamSets, bsIndependencyFlag, firstObject, numObjects ); | | |
| if ( numDmxChannels > 1 ) { | | |
| [cld, cldQuantCoarse, cldFreqResStride] = | | |
| EcData( t_CLD, prevCldQuantCoarse, prevCldFreqResStride, | | |
| numParamSets, bsIndependencyFlag, firstObject, numObjects ); | | |
| } | | |
| if (bsPostDownmix ! = 0 ) { | | |
| for ( i=0; i<numDmxChannels;i++){ | | |
| EcData(t_CLD, prevMdgQuantCoarse[i], prevMdgFreqResStride[i], | | |
| numParamSets, , bsIndependencyFlag, startBand, numBands ); | | |
| } | | |
| ByteAlign( ); | | |
| SAOCExtensionFrame( ); | | |
| } | | |

Note 1:
FramingInfo( ) is defined in ISO/IEC 23003-1: 2007, Table 16.
Note 2:
EcData( ) is defined in ISO/IEC 23003-1: 2007, Table 23.

TABLE 26

| Syntax of SpatialExtensionFrameData(1) | | |
|---|---|---|
| Syntax | No. of bits | Mnemonic |
| SpatialExtensionDataFrame(1) | | |
| { | | |

TABLE 26-continued

| Syntax of SpatialExtensionFrameData(1) | | |
|---|---|---|
| Syntax | No. of bits | Mnemonic |
| PostDownmixResidualData( ); | | |
| } | | |

TABLE 27

| Syntax of PostDownmixResidualData( ) | | |
|---|---|---|
| Syntax | No. of bits | Mnemonic |
| PostDownmixResidualData( ) | | |
| { | | |
| resFrameLength = numSlots / | | Note 1 |
| (bsPostDownmixResidualFramesPerSpatialFrame + 1); | | |
| for (i = 0; i < numAacEl; i++) { | | Note 2 |
| bsPostDownmixResidualAbs[i] | 1 | Uimsbf |

TABLE 27-continued

Syntax of PostDownmixResidualData( )

| Syntax | No. of bits | Mnemonic |
|---|---|---|
| bsPostDownmixResidualAlphaUpdateSet[i] | 1 | Uimsbf |
| for (rf = 0; rf < bsPostDownmixResidualFramesPerSpatialFrame + 1;rf++) | | |
| if (AacEl[i] == 0) { | | |
| individual_channel_stream(0); | | Note 3 |
| else{ | | Note 4 |
| channel_pair_element( ); | | |
| } | | Note 5 |
| if (window_sequence = EIGHT_SHORT_SEQUENCE) && | | |
| ((resFrameLength == 18) ‖ (resFrameLength == 24) ‖ | | Note 6 |
| (resFrameLength == 30)) { | | |
| if(AacEl[i] == 0) { | | |
| individual_channel_stream(0); | | |
| else{ | | Note 4 |
| channel_pair_element( ); | | |
| } | | Note 5 |
| } | | |
| } | | |
| } | | |
| } | | |

Note 1:
numSlots is defined by numSlots = bsFrameLength + 1. Furthermore the division shall be interpreted as ANSI C integer division.
Note 2:
numAacEl indicates the number of AAC elements in the current frame according to Table 81 in ISO/IEC 23003-1.
Note 3:
AacEl indicates the type of each AAC element in the current frame according to Table 81 in ISO/IEC 23003-1.
Note 4:
individual_channel_stream(0) according to MPEG-2 AAC Low Complexity profile bitstream syntax described in subclause 6.3 of ISO/IEC 13818-7.
Note 5:
channel_pair_element( ); according to MPEG-2 AAC Low Complexity profile bitsream syntax described in subclause 6.3 of ISO/IEC 13818-7. The parameter common_window is set to 1.
Note 6:
The value of window_sequence is determined in individual_channel_stream(0) or channel_pair_element( ).

The syntaxes of the MPEG-D SAOC to support the extended downmix are shown in Table 8 through Table 12, and the syntaxes of the MPEG-D SAOC to support the enhanced downmix are shown in Table 13 through Table 17. Also, the syntaxes of the MPEG-D SAOC to support the professional downmix are shown in Table 18 through Table 22, and the syntaxes of the MPEG-D SAOC to support the post downmix are shown in Table 23 through Table 27.

Referring to FIG. 9, a Quadrature Mirror Filter (QMF) analysis 901, 902, and 903 may be performed with respect to an audio object (1) 907, an audio object (2) 908, and an audio object (3) 909, and thus a spatial analysis 904 may be performed. A QMF analysis 905 and 906 may be performed with respect to an inputted post downmix signal (1) 910 and an inputted post downmix signal (2) 911, and thus the spatial analysis 904 may be performed. The inputted post downmix signal (1) 910 and the inputted post downmix signal (2) 911 may be directly outputted as a post downmix signal (1) 915 and a post downmix signal (2) 916 without a particular process.

When the spatial analysis 904 is performed with respect to the audio object (1) 907, the audio object (2) 908, and the audio object (3) 909, a standard spatial parameter 912 and a Post Downmix Gain (PDG) 913 may be generated. An SAOC bitstream 914 may be generated using the generated standard spatial parameter 912 and PDG 913.

The multi-object audio encoding apparatus according to an embodiment of the present invention may generate the PDG to process a downmix signal and the post downmix signals 910 and 911, for example, a mastering downmix signal. The PDG may be a downmix information parameter to compensate for a difference between the downmix signal and the post downmix signal, and may be included in the SAOC bitstream 914. In this instance, a structure of the PDG may be basically identical to an ADG of the MPEG Surround scheme.

Accordingly, the multi-object audio decoding apparatus according to an embodiment of the present invention may compensate for the downmix signal using the PDG and the post downmix signal. In this instance, the PDG may be quantized using a quantization table identical to a CLD of the MPEG Surround scheme.

A result of comparing the PDG with other spatial parameters such as OLD, NRG, IOC, DMG, and DCLD, is shown in Table 28 below. The PDG may be dequantized using a CLD quantization table of the MPEG Surround scheme.

TABLE 28 comparison of dimensions and value ranges of PDG and other spatial parameters

| Parameter | idxOLD | idxNRG | idxIOC | idxDMG | idxDCLD | idxPDG |
|---|---|---|---|---|---|---|
| Dimension | [pi][ps][pb] | [ps][pb] | [pi][pi][ps][pb] | [ps][pi] | [ps][pi] | [ps][pi] |
| Value range | 0 . . . 15 | 0 . . . 63 | 0 . . . 7 | −15 . . . 15 | −15 . . . 15 | −15 . . . 15 |

The post downmix signal may be compensated for using a dequantized PDG, which is described below in detail.

In the post downmix signal compensation, a compensated downmix signal may be generated by multiplying a mixing matrix with an inputted downmix signal. In this instance, when a value of bsPostDownmix in a Syntax of SAOC-SpecificConfig( ) is 0, the post downmix signal compensation may not be performed. When the value is 1, the post downmix signal compensation may be performed. That is, when the value is 0, the inputted downmix signal may be directly outputted with a particular process. When a mixing matrix is a mono downmix, the mixing matrix may be represented as Equation 10 given as below. When the mixing matrix is a stereo downmix, the mixing matrix may be represented as Equation 11 given as below.

$$W_{PDG}^{l,m}=[1] \quad \text{[Equation 10]}$$

$$W_{PDG}^{l,m}=\begin{bmatrix}1 & 0\\ 0 & 1\end{bmatrix} \quad \text{[Equation 11]}$$

When the value of bsPostDownmix is 1, the inputted downmix signal may be compensated through the dequantized PDG. When the mixing matrix is the mono downmix, the mixing matrix may be defined as, $$W_{PDG}^{l,m}=[w_1^{l,m}] \quad \text{[Equation 12]}$$

where $w_1^{l,m}$ may be calculated using the dequantized PDG, and be represented as, $$w_1^{l,m}=D_{PDG}(0,l,m),0\leq m<M_{proc},0\leq l<L \quad \text{[Equation 13]}$$

When the mixing matrix is the stereo downmix, the mixing matrix may be defined as, $$W_{PDG}^{l,m}=\begin{bmatrix}w_1^{l,m} & 0\\ 0 & w_2^{l,m}\end{bmatrix} \quad \text{[Equation 14]}$$

where $w_x^{l,m}$ may be calculated using the dequantized PDG, and be represented as, $$w_X^{l,m}=D_{PDG}(X,l,m),0\leq X<2,0\leq m<M_{proc},0\leq l<L \quad \text{[Equation 15]}$$

Also, syntaxes to transmit the PDG in a bitstream are shown in Table 29 and Table 30. Table 29 and Table 30 show a PDG when a residual coding is not applied to completely restore the post downmix sign, in comparison to the PDG represented in Table 23 through Table 27.

TABLE 29

Syntax of SAOCSpecificConfig( )

| Syntax | No. of bits | Mnemonic |
|---|---|---|
| SAOCSpecificConfig( ) | | |
| { | | |
| bsSamplingFrequencyIndex; | 4 | uimsbf |
| if ( bsSamplingFrequencyIndex == 15 ) { | | |
| bsSamplingFrequency; | 24 | uimsbf |
| } | | |
| bsFreqRes; | 3 | uimsbf |
| bsFrameLength; | 7 | uimsbf |
| frameLength = bsFrameLength + 1; | | |
| bsNumObjects; | 5 | uimsbf |
| numObjects = bsNumObjects+1; | | |
| for ( i=0; i<numObjects; i++ ) { | | |
| bsRelatedTo[i][i] = 1; | | |
| for( j=i+1; j<numObjects; j++ ) { | | |
| bsRelatedTo[i][j]; | 1 | uimsbf |
| bsRelatedTo[j][i] = bsRelatedTo[i][j]; | | |
| } | | |
| } | | |
| bsTransmitAbsNrg; | 1 | uimsbf |
| bsNumDmxChannels; | 1 | uimsbf |
| numDmxChannels = bsNumDmxChannels + 1; | | |
| if ( numDmxChannels == 2 ) { | | |
| bsTttDualMode; | 1 | uimsbf |
| if (bsTttDualMode) { | | |
| bsTttBandsLow; | 5 | uimsbf |
| } | | |
| else { | | |
| bsTttBandsLow = numBands; | | |
| } | | |
| } | | |
| bsPostDownmix; | 1 | uimsbf |
| ByteAlign( ); | | |
| SAOCExtensionConfig( ); | | |
| } | | |

TABLE 30

Syntax of SAOCFrame( )

| Syntax | No. of bits | Mnemonic |
|---|---|---|
| SAOCFrame( ) | | |
| { | | |
| FramingInfo( ); | | Note 1 |
| bsIndependencyFlag; | 1 | uimsbf |
| startBand = 0; | | |
| for( i=0; i<numObjects; i++ ) { | | |
| [old[i], oldQuantCoarse[i], oldFreqResStride[i]] = | | Notes 2 |
| EcData( t_OLD, prevOldQuantCoarse[i], prevOldFreqResStride[i], | | |
| numParamSets, bsIndependencyFlag, startBand, numBands ); | | |
| } | | |
| if ( bsTransmitAbsNrg ) { | | |
| [nrg, nrgQuantCoarse, nrgFreqResStride] = | | Notes 2 |
| EcData( t_NRG, prevNrgQuantCoarse, prevNrgFreqResStride, | | |
| numParamSets, bsIndependencyFlag, startBand, numBands ); | | |
| } | | |

TABLE 30-continued

| Syntax of SAOCFrame( ) | | |
|---|---|---|
| Syntax | No. of bits | Mnemonic |
| for( i=0; i<numObjects; i++ ) { | | |
| for( j=i+1; j<numObjects; j++ ) { | | |
| if ( bsRelatedTo[i][j] != 0 ) { | | |
| [ioc[i][j], iocQuantCoarse[i][j], iocFreqResStride[i][j] = | | Notes 2 |
| EcData( t_ICC, prevIocQuantCoarse[i][j], | | |
| prevIocFreqResStride[i][j], numParamSets, | | |
| bsIndependencyFlag, startBand, numBands ); | | |
| } | | |
| } | | |
| } | | |
| firstObject = 0; | | |
| [dmg, dmgQuantCoarse, dmgFreqResStride] = | | |
| EcData( t_CLD, prevDmgQuantCoarse, prevIocFreqResStride, | | |
| numParamSets, bsIndependencyFlag, firstObject, numObjects ); | | |
| if ( numDmxChannels > 1 ) { | | |
| [cld, cldQuantCoarse, cldFreqResStride] = | | |
| EcData( t_CLD, prevCldQuantCoarse, prevCldFreqResStride, | | |
| numParamSets, bsIndependencyFlag, firstObject, numObjects ); | | |
| } | | |
| if ( bsPostDownmix ) { | | |
| for( i=0; i<numDmxChannels; i++ ) { | | |
| EcData( t_CLD, prevPdgQuantCoarse, prevPdgFreqResStride[i], | | |
| numParamSets, bsIndependencyFlag, startBand, numBands ); | | |
| } | | |
| ByteAlign( ); | | |
| SAOCExtensionFrame( ); | | |
| } | | |

Note 1:
FramingInfo( ) is defined in ISO/IEC 23003-1: 2007, Table 16.
Note 2:
EcData( ) is defined in ISO/IEC 23003-1: 2007, Table 23.

A value of bsPostDownmix in Table 29 may be a flag indicating whether the PDG exists, and may be indicated as below.

TABLE 31

| bsPostDownmix | |
|---|---|
| bsPostDownmix | Post down-mix gains |
| 0 | Not present |
| 1 | Present |

A performance of supporting the post downmix signal using the PDG may be improved by residual coding. That is, when the post downmix signal is compensated for using the PDG for decoding, a sound quality may be degraded due to a difference between an original downmix signal and the compensated post downmix signal, as compared to when the downmix signal is directly used.

To overcome the above-described disadvantage, a residual signal may be extracted, encoded, and transmitted from the multi-object audio encoding apparatus. The residual signal may indicate the difference between the downmix signal and the compensated post downmix signal. The multi-object audio decoding apparatus may decode the residual signal, and add the residual signal to the compensated post downmix signal to adjust the residual signal to be similar to the original downmix signal. Accordingly, the sound degradation may be reduced.

Also, the residual signal may be extracted from an entire frequency band. However, since a bit rate may significantly increase, the residual signal may be transmitted in only a frequency band that practically affects the sound quality. That is, when sound degradation occurs due to an object having only low frequency components, for example, a bass, the multi-object audio encoding apparatus may extract the residual signal in a low frequency band and compensate for the sound degradation.

In general, since sound degradation in a low frequency band may be compensated for based on a recognition nature of a human, the residual signal may be extracted from a low frequency band and transmitted. When the residual signal is used, the multi-object audio encoding apparatus may add a same amount of a residual signal, determined using a syntax table shown as below, as a frequency band, to the post downmix signal compensated for according to Equation 9 through Equation 14.

TABLE 32

| bsSAOCExtType | |
|---|---|
| bsSaocExtTyp | Meaning |
| 0 | Residual coding data |
| 1 | Post-downmix residual coding data |
| 2 . . . 7 | Reserved. SAOCExtensionFrameData( ) present |
| 8 | Object metadata |
| 9 | Preset information |
| 10 | Separation metadata |
| 11 . . . 15 | Reserved. SAOCExtensionFrameData( ) not present |

TABLE 33

| Syntax of SAOCExtensionConfigData(1) | | |
|---|---|---|
| Syntax | No. of bits | Mnemonic |
| SAOCExtensionConfigData( 1) | | |
| { | | |

TABLE 33-continued

| Syntax of SAOCExtensionConfigData(1) | | |
|---|---|---|
| Syntax | No. of bits | Mnemonic |
| PostDownmixResidualConfig( ); | | |
| } | | |
| SpatialExtensionConfigData(1) | | |

Syntactic element that, if present, indicates that post downmix residual coding information is available.

TABLE 34

| Syntax of PostDownmixResidualConfig( ) | | |
|---|---|---|
| Syntax | No. of bits | Mnemonic |
| PostDownmixResiduafConfig( ) | | |
| { | | |
| bsPostDownmixResidualSampingFrequencyIndex | 4 | uimsbf |
| bsPostDownmixResidualFramesPerSpatialFrame | 2 | uimsbf |
| bsPostDwonmixResidualBands | 5 | uimsbf |
| } | | |

bsPostDowrmixResidualSampingFrequencyIndex

Determines the sampling frequency assumed when decoding the AAC individual channel streams or channel pair elements, according to ISO/IEC 14496-4.

bsPostDownmixResidualFramesPerSpatialFrame

Indicates the number of post downmixresidual frames per spatial frame, ranging from one to four bsPostDwonmixResidualBands Defines the number of parameter bands 0 <= bsPostDownmixResidualBands < numBands for which post down-mix residual signal information is present.

TABLE 35

| Syntax of SpatialExtensionFrameData(1) | | |
|---|---|---|
| Syntax | No. of bits | Mnemonic |
| SpatialExtensionDataFrame(1) | | |
| { | | |
| PostDownmixResidualData( ); | | |
| } | | |
| SpatialExtensionDataFrame(1) | | |

Syntactic element that, if present, indicates that post downmix residual coding information is available.

TABLE 36

| Syntax of PostDownmixResidualData( ) | | |
|---|---|---|
| Syntax | No. of bits | Mnemonic |
| PostDownmixResidualData( ) | | |
| { | | |
| resFrameLength = numSlots / (bsPostDownmixResidualFramesPerSpatialFrame + 1); | | Note 1 |
| for (i = 0; i < numAacEl; i++) { | | Note 2 |
| bsPostDownmixResidualAbs[i] | 1 | Uimsbf |
| bsPostDownmixResidualAlphaUpdateSet[i] | 1 | Uimsbf |
| for (rf = 0; rf < bsPostDownmixResidualFramesPerSpatialFrame + 1;rf++) | | |
| if (AacEl[i] == 0) { | | |
| individual_channel_stream(0); | | Note 3 |
| else{ | | Note 4 |
| channel_pair_element( ); | | |
| } | | Note 5 |
| if (window_sequence == EIGHT_SHORT_SEQUENCE) && ((resFrameLength == 18) \|\| (resFrameLength == 24) \|\| (resFrameLength == 30)) { | | Note 6 |
| if (AacEl[i] == 0) { | | |
| individual_channel_stream(0); | | |
| else{ | | Note 4 |
| channel_pair_element( ); | | |

TABLE 36-continued

| Syntax of PostDownmixResidualData( ) | | |
|---|---|---|
| Syntax | No. of bits | Mnemonic |
| } | | Note 5 |
| } | | |
| } | | |
| } | | |
| } | | |
| } | | |

Note 1:
numSlots is defined by numSlots = bsFrameLength + 1. Furthermore the division shall be interpreted as ANSI C integer division.
Note 2:
numAacEl indicates the number of AAC elements in the current frame according to Table 81 in ISO/IEC 23003-1.
Note 3:
AacEl indicates the type of each AAC element in the current frame according to Table 81 in ISO/IEC 23003-1.
Note 4:
individual_channel_stream(0) according to MPEG-2 AAC Low Complexity profile bitstream syntax described in subclause 6.3 of ISO/IEC 13818-7.
Note 5:
channel_pair_element( ); according to MPEG-2 AAC Low Complexity profile bitsream syntax described in subclause 6.3 of ISO/IEC 13818-7. The parameter common_window is set to 1.
Note 6:
The value of window_sequence is determined in individual_channel_stream(0) or channel_pair_element( ).

Although a few embodiments of the present invention have been shown and described, the present invention is not limited to the described embodiments. Instead, it would be appreciated by those skilled in the art that changes may be made to these embodiments without departing from the principles and spirit of the invention, the scope of which is defined by the claims and their equivalents.

The invention claimed is:

1. A multi-object audio encoding apparatus, comprising:

at least one hardware processor to:

generate object information using input object signals and extract a downmix signal from the input object signals;

determine a Post Downmix Gain (PDG) to compensate for a difference between the extracted downmix signal and a post downmix signal supplied from a source that is external to the multi-object audio encoding apparatus, the PDG being useable to adjust for the post downmix signal according to a relationship between the extracted downmix signal and the post downmix signal; and generate an object bitstream including the PDG and the object information, wherein the difference between the downmix signal and the post downmix signal is compensated by applying a mixing matrix including the PDG included with the object bitstream generated at the multi-object audio encoding apparatus, wherein the mixing matrix is determined based on either mono downmix or stereo downmix.

2. The multi-object audio encoding apparatus of claim 1, wherein the object information comprises spatial cue parameters predicted from the input object signals.

3. The multi-object audio encoding apparatus of claim 1, wherein the at least one processor is configured operate as:

a power offset calculator that scales the post downmix signal as a predetermined value to enable an average power of the post downmix signal in a particular frame to be identical to an average power of the downmix signal; and a parameter extractor that extracts the PDG from the scaled post downmix signal in a predetermined frame.

4. The multi-object audio encoding apparatus of claim 1, wherein the at least one processor calculates a Downmix Channel Level Difference (DCLD) and a Downmix Gain (DMG) indicating a mixing amount of the input object signals.

5. The multi-object audio encoding apparatus of claim 1, wherein the at least one processor generates a residual signal corresponding to the difference between the downmix signal and the post downmix signal, and transmits the object bitstream including the residual signal, the difference between the downmix signal and the post downmix signal being compensated for by applying the PDG.

6. The multi-object audio encoding apparatus of claim 5, wherein the residual signal is generated with respect to a frequency band that affects a sound quality of the input object signals, and transmitted through the object bitstream.

7. A multi-object audio decoding apparatus which decodes a multi-object audio, comprising:

at least one hardware processor to:

extracting a Post Downmix Gain (PDG) and object information from an object bitstream;

decoding a downmix signal using the object information and generates an object signal; and compensating a difference between the downmix signal and a post downmix signal supplied from a source that is external to the multi-object audio decoding apparatus, based on the PDG, the PDG being useable to adjust for the post downmix signal according to a relationship between the decoded downmix signal and the post downmix signal, wherein the difference between the downmix signal and the post downmix signal is compensated by applying a mixing matrix including PDG transmitted to include the object bitstream to the multi-object audio decoding apparatus, wherein the mixing matrix is determined based on either mono downmix or stereo downmix.

8. The multi-object audio decoding apparatus of claim 7, wherein the object information comprises spatial cue parameters predicted from input object signals.

9. The multi-object audio decoding apparatus of claim 8, user control information is applied to the object signal generated from the decoding to generate a reproducible output signal.

10. The multi-object audio decoding apparatus of claim 8, wherein the at least one processor is configured operate as:

a power offset compensator that scales the post downmix signal using a power offset value extracted from the PDG as a downmix information parameter; and a downmix signal adjustor that converts the scaled post downmix signal into the downmix signal using the PDG.

11. The multi-object audio decoding apparatus of claim 10, wherein a residual signal is referenced to the post downmix signal, which is compensated for by using the PDG, and the post downmix signal is adjusted to be similar to the downmix signal, and the residual signal is the difference between the downmix signal and the post downmix signal, the difference between the downmix signal and the post downmix signal being compensated for by applying the PDG.

* * * * *